US011837831B2

(12) United States Patent
Witte

(10) Patent No.: US 11,837,831 B2
(45) Date of Patent: Dec. 5, 2023

(54) SPRING-CLAMP TERMINAL BLOCK

(71) Applicant: WAGO Verwaltungsgesellschaft mbH, Minden (DE)

(72) Inventor: Thomas Witte, Porta Westfalica (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 356 days.

(21) Appl. No.: 17/338,318

(22) Filed: Jun. 3, 2021

(65) Prior Publication Data

US 2021/0288416 A1 Sep. 16, 2021

Related U.S. Application Data

(63) Continuation of application No. PCT/IB2019/059918, filed on Nov. 19, 2019.

(30) Foreign Application Priority Data

Dec. 4, 2018 (DE) ..... 20 2018 106 897.0

(51) Int. Cl.

| | |
|---|---|
| ***H01R 4/24*** | (2018.01) |
| ***H01R 4/48*** | (2006.01) |
| ***H01R 9/24*** | (2006.01) |
| ***H01R 9/26*** | (2006.01) |

(52) U.S. Cl.

CPC ..... *H01R 4/4845* (2013.01); *H01R 9/2416* (2013.01); *H01R 9/2675* (2013.01)

(58) Field of Classification Search

CPC .. H01R 4/2433; H01R 4/2404; H01R 4/2412; H01R 4/40; H01R 2103/00; H01R 4/2491; H01R 4/4845

See application file for complete search history.

(56) References Cited

U.S. PATENT DOCUMENTS

| | | | | |
|---|---|---|---|---|
| 10,014,596 | B2 | 7/2018 | Hartmann | |
| 10,559,897 | B1 * | 2/2020 | Rangi | H01R 4/58 |
| 10,594,053 | B2 * | 3/2020 | Koellmann | H01R 4/4836 |
| 10,686,262 | B2 * | 6/2020 | Wu | H01R 4/4818 |
| 10,707,594 | B1 * | 7/2020 | Wu | H01R 4/4836 |
| 10,784,599 | B2 * | 9/2020 | Schrader | H01R 4/4836 |
| 11,024,987 | B2 * | 6/2021 | Koellmann | H01R 4/4836 |

FOREIGN PATENT DOCUMENTS

| | | | |
|---|---|---|---|
| DE | 102015104625 | A1 | 9/2016 |
| DE | 102016116966 | A1 | 3/2018 |
| WO | WO2016184934 | A1 | 11/2016 |

OTHER PUBLICATIONS

International Search Report dated Jun. 23, 2020 in corresponding application PCT/IB2019/059918.

* cited by examiner

*Primary Examiner* — Phuong Chi Thi Nguyen

(74) *Attorney, Agent, or Firm* — Muncy, Geissler, Olds & Lowe, P.C.

(57) ABSTRACT

A spring-clamp terminal block for connecting an electrical conductor, with a bus bar, a clamping spring, a housing and a lever, wherein the lever has a bearing plate with a partially circular outer contour for mounting the lever in a counter bearing, and wherein the lever has a follower which is designed to move the clamping arm out of a closed position into an open position when the lever is actuated.

20 Claims, 15 Drawing Sheets

SPRING-CLAMP TERMINAL BLOCK

This nonprovisional application is a continuation of International Application No. PCT/162019/059918, which was filed on Nov. 19, 2019 and which claims priority to German Patent Application No. 20 2018 106 897.0, which was filed in Germany on Dec. 4, 2018 and which are both herein incorporated by reference.

BACKGROUND OF THE INVENTION

Field of the Invention

The present invention relates to a spring-clamp terminal block for electrical conductors.

Description of the Background Art

A spring-clamp terminal block, which can also be referred to as a conductor connection terminal, with a housing, a pivoting lever, a current bar accessible via an insertion opening of the housing, and a clamping spring is known, for example, from DE 10 2015 104 625 A1. The pivoting lever of the conductor connection terminal has an axial strut which is rotatably mounted in the housing and about which the pivoting lever can be pivoted between its open position and closed position. Between an actuation handle and a pressure element of the pivoting lever, a receiving opening of the pivoting lever is formed through which a retaining limb and a clamping limb of the clamping spring are fed.

DE 10 2016 116 966 A1 relates to a spring-loaded clamping connection with at least one clamping spring for clamping an electrical conductor to the spring-loaded clamping connection. The spring-loaded clamping connection has an actuation element for opening a clamping point for the electrical conductor, which is at least partially formed by a clamping edge of the clamping spring. The actuation element has a spring engagement area which is designed to deflect an actuation section of the clamping spring at least when the clamping point is opened. The actuation element is supported on a support section of the clamping spring with respect to the clamping spring force acting on the spring engagement area.

SUMMARY OF THE INVENTION

It is therefore an object of the present invention to provide a spring-clamp terminal block which is as improved as possible.

Accordingly, a spring-clamp terminal block is provided for connecting an electrical conductor. The spring-clamp terminal block has a busbar and a clamping spring and a housing and a lever.

The busbar and the clamping spring and the lever are accommodated at least partially in the housing.

The lever has a first bearing plate with a first partially circular outer contour for mounting the lever in a first counter bearing.

The lever has an actuation handle which is connected to the first bearing plate.

The clamping spring has a clamping arm. The clamping arm together with the busbar forms a clamping point for clamping the electrical conductor on the busbar.

The lever has a follower which is designed to move the clamping arm out of a closed position into an open position when the lever is actuated.

The lever can have a second bearing plate with a second partially circular outer contour for mounting the lever in a second counter bearing. The second bearing plate is spaced apart from the first bearing plate. The actuation handle of the lever is connected to the first bearing plate and to the second bearing plate.

A width of the spring-clamp terminal block can be defined solely by the sum of the thicknesses of the outer walls adjacent to the first bearing plate and the second bearing plate, by the thicknesses of the first bearing plate and the second bearing plate, and by the width of the space between the first bearing plate and the second bearing plate.

The clamping spring can have a spring bend and a contact arm. The clamping arm is connected via the spring bend to the contact arm. Advantageously, the spring-clamp terminal block has exactly one clamping arm, which is connected to the spring bend. This makes it possible to achieve a compact design. According to a further refinement, in the closed position, the clamping arm and the contact arm are substantially parallel to one another in a region. In this regard, the region is adjacent to the spring bend. In an advantageous refinement, under preload the clamping arm bears with a clamping edge against the busbar. In the closed position, a free end of the clamping arm advantageously points in the direction of the contact arm with the clamping edge.

a radius of the first bearing plate can be larger than a thickness of the first bearing plate, so that for support the first bearing plate slides on its outer contour (bearing surface).

A radius of the second bearing plate can be larger than a thickness of the second bearing plate, so that for support the second bearing plate slides on its outer contour (bearing surface).

The first bearing plate can be mounted on a wall of the spring-clamp terminal block for axial mounting. In an advantageous refinement, the second bearing plate can be mounted on a wall of the spring-clamp terminal block for axial mounting. For example, a sliding bearing is provided for the axial mounting.

The first counter bearing can have a first bearing shell. The bearing shell can be formed at least from a first section of the busbar and a first section of a contact arm of the clamping spring.

The second counter bearing can have a second bearing shell. The second bearing shell can be formed at least from a second section of the busbar and a second section of a contact arm of the clamping spring.

The first section of the busbar and the first section of the contact arm can be arranged at an obtuse angle to form the first bearing shell.

The second section of the busbar and the second section of the contact arm can be arranged at an obtuse angle to form the second bearing shell.

The first bearing shell and/or the second bearing shell can have at least one straight section and/or at least one partially circular section. For example, a section of the busbar is at least partially straight and/or at least partially configured as a partial circle. For example, a section of the contact arm of the clamping spring is at least partially straight and/or at least partially configured as a partial circle.

A contact arm of the clamping spring can have an opening for feeding the electrical conductor through the opening to the clamping point. The opening extends at least over the height and width of the conductor with a diameter allowed for the spring-clamp terminal block. The opening advantageously extends into the spring bend. This makes it possible, for example, to integrate additional functions into the spring-clamp terminal block, for example, to feed a pusher through the opening.

The contact arm of the clamping spring can have a first web and a second web. The first web and the second web advantageously delimit the opening in the contact arm.

In an advantageous refinement, the opening is closed in that the opening is surrounded on all sides by the material of the clamping spring. For example, the opening in the clamping spring is created by punching out.

The first web can form a support for the first bearing plate of the lever. The first web is therefore part of the first counter bearing and forms part of the first bearing shell. In an advantageous refinement, the second web forms a support for a second bearing plate of the lever. The second web is therefore part of the second counter bearing and forms part of the second bearing shell.

The housing can have a first guide wall and/or a second guide wall of a conductor guide channel. The conductor guide channel guides the electrical conductor to the clamping point. The electrical conductor is inserted into the conductor guide channel from the outside through a conductor opening. The first guide wall advantageously ends at the opening in the contact arm; for example, the first guide wall is adjacent to the first web delimiting the opening. The second guide wall advantageously ends at the opening in the contact arm; for example, the second guide wall is adjacent to the second web delimiting the opening. It is also possible for the first guide wall and/or the second guide wall to pass through the opening in the contact arm. In an advantageous refinement, the housing comprises a base body and a cover. The first guide wall and/or the second guide wall are advantageously formed in the cover of the housing.

The first bearing shell can have a first busbar wall section of the busbar with a partially circular inner contour.

The second bearing shell can have a second busbar wall section of the busbar with a partially circular inner contour.

A conductor guide channel for receiving the conductor in the region of the first bearing plate and the second bearing plate can be formed by a space between the first bearing plate and the second bearing plate. The space is advantageously delimited on at least one side by the busbar.

The follower can be disposed closer to the contact arm in the closed position than in the open position.

The busbar can have a first prong of a bifurcated contact and the clamping spring has a second prong of the bifurcated contact.

A further inventive aspect is a spring-clamp terminal block for connecting an electrical conductor, with a busbar and with a clamping spring and with a housing and with a lever.

The busbar and the clamping spring and the lever can be accommodated at least partially in the housing.

The clamping spring can have a clamping arm. The clamping arm together with the busbar forms a clamping point for clamping the electrical conductor on the busbar.

The lever can be designed to move the clamping arm out of a closed position into an open position.

The busbar can have a first prong of a bifurcated contact.

The clamping spring can have a second prong of the bifurcated contact. The contact arm and the second prong are preferably formed in one piece from a spring steel. Advantageously, the second prong bears against the first prong with a preload if no contact blade is inserted into the bifurcated contact.

The contact arm of the clamping spring can bear against the busbar on a side opposite the clamping point.

The busbar can have a contact section with the clamping point, a connecting section, and a first prong of a bifurcated contact. The contact section of the busbar can also be referred to as the bottom section. The connecting section advantageously connects the contact section to the first prong. The contact section and the connecting section and the first prong are advantageously formed in one piece from a metal part.

The connecting section of the busbar can be formed predominantly perpendicular to the contact section.

The connecting section of the busbar can be formed predominantly perpendicular to the first prong.

The clamping spring can be supported on the connecting section. The clamping spring preferably has a first bearing element for support on a connecting section side, facing the clamping point, and/or a second bearing element for support on a connecting section side, facing away from the clamping point. The first bearing element and/or the second bearing element are advantageously formed in one piece from the contact arm. The first bearing element and/or the second bearing element are advantageously formed by opening out a tab from the contact arm. For example, the first bearing element and/or the second bearing element are advantageously formed by an edge of a tab.

The lever can be pivoted for actuation. In an advantageous refinement, the lever can be moved predominantly in a translational manner for actuation. The first counter bearing and/or the second counter bearing are advantageously designed for translational movement of the lever. If the user presses on the actuation section, for example, the lever slides into the open position in a predominantly translational movement for moving the clamping arm. In an advantageous refinement, the first counter bearing and/or the second counter bearing are additionally designed for pivoting the lever, so that actuation of the lever in a predominantly rotational movement moves the clamping arm into the open position. For example, the first counter bearing and/or the second counter bearing enable a translational and a rotational movement of the lever, so that the clamping arm can be actuated out of the closed position into the open position by the rotational pivoting of the actuation handle and/or by the translational pressing of the actuation handle.

The follower can be designed as a strut. The strut is advantageously disposed between the first bearing plate and the second bearing plate. The strut advantageously connects the first bearing plate to the second bearing plate. For example, the strut has a constant cross-sectional shape between the first bearing plate and the second bearing plate. The strut is advantageously formed in one piece. Alternatively, the strut can be formed of two parts, wherein a first part of the strut is formed on the first bearing plate and a second part of the strut is formed on the second bearing plate.

The follower and the first bearing plate and the second bearing plate can be formed in one piece. For example, the first bearing plate and the second bearing plate and the follower are formed in one piece from a plastic part by injection molding. The entire lever is advantageously formed in one piece.

The follower can be disposed at least partially within the circular shape of the first bearing plate. The circular shape is formed by a partially circular outer contour of the first bearing plate. Beyond the partially circular outer contour, the shape of the first bearing plate can deviate from an exact circle. The follower is advantageously disposed at least partially within the circular shape of the second bearing plate. The circular shape is formed here by a partially circular outer contour of the second bearing plate. Beyond the partially circular outer contour, the shape of the second bearing plate can deviate from an exact circle. For example, the first outer contour and/or the second outer contour are formed in sections as an eccentric or oval.

The first partially circular outer contour of the first bearing plate and/or the second partially circular outer contour of the second bearing plate can define an axis of rotation of the lever when the lever is pivoted out of the closed position into the open position. Advantageously, the lever can be pivoted back manually in a counter-rotating pivoting movement out of the open position into the closed position. In the open position and in the closed position, the follower is preferably disposed outside a space between the busbar and a plane parallel thereto through the axis of rotation. The follower is thus advantageously disposed outside the conductor guide channel in the open position and closed position. An inserted conductor does not collide with the follower. The follower does not have a guide function for guiding the conductor.

The first partially circular outer contour of the first bearing plate and/or the second partially circular outer contour of the second bearing plate can define an axis of rotation of the lever when the lever is pivoted out of the closed position into the open position. In an advantageous refinement, the follower has a curved surface. The follower is advantageously disposed and shaped such that when the lever is pivoted, the distance of the surface region, in contact with the clamping arm, from the axis of rotation changes. The distance to the axis of rotation in the open position is advantageously greater than in the closed position. For example, the follower has a predominantly oval or predominantly elliptical cross-sectional shape.

The follower can extend predominantly parallel to the axis of rotation. For example, the follower extends from the first bearing plate to the second bearing plate parallel to the axis of rotation. It is also possible that the follower is formed in two parts or in multiple parts and that the parts of the follower extend predominantly parallel to the axis of rotation.

The clamping spring can have a spring bend and a contact arm. The clamping arm is connected via the spring bend to the contact arm. The follower is advantageously disposed between the contact arm and the clamping arm. For example, the follower is disposed completely between the contact arm and the clamping arm.

The first bearing plate can be guided axially by a first outer wall of the housing. Advantageously, the axial guidance of the first bearing plate is formed exclusively by the first outer wall. In an advantageous refinement, the second bearing plate is guided axially by a second outer wall of the housing. Advantageously, the axial guidance of the second bearing plate is formed exclusively by the second outer wall. An outer wall is to be understood as a wall of the spring-clamp terminal block that electrically insulates the electrical contact insert comprising the busbar and the clamping spring to the outside. Accordingly, an outer wall is also to be understood as a wall that electrically insulates two adjacent contact inserts from one another. Each contact insert is associated with a spring-clamp terminal block, wherein the housing of two spring-clamp terminal blocks can be formed in one piece. It is possible in this case for the same wall to function as the outer wall of two adjacent spring-clamp terminal blocks.

The first bearing shell can have the first section of the busbar and the first section of the contact arm and a first section of the housing. The first bearing shell is formed by three different parts. In an advantageous refinement, the second bearing shell has the second section of the busbar and the second section of the contact arm and a second section of the housing. The second bearing shell is formed by three different parts. This makes it possible to divide the functions of guidance and the application of force and to create a compact spring-clamp terminal block.

The housing can have a receiving part with an interior space for receiving at least the busbar and a cover. The cover closes a receiving part opening, facing the interior space. By designing the housing as the receiving part and cover, a compact shape of the spring-clamp terminal block can be achieved. In an advantageous refinement, at least one conductor guide channel, which has guide walls for guiding the electrical conductor to the clamping point, is formed in the cover.

A conductor guide channel for receiving the electrical conductor in the region of the first bearing plate and the second bearing plate can be formed at least partially by a space between the first bearing plate and the second bearing plate. In addition, the space can be limited by the busbar in the bottom region. Advantageously, a first housing guide wall of the conductor guide channel and a first inner side of the first bearing plate, said inner side facing the electrical conductor, are aligned at least in the conductor insertion direction. Advantageously, a second housing guide wall of the conductor guide channel and a second inner side of the second bearing plate, said inner side facing the electrical conductor, are aligned at least in the conductor insertion direction. In this regard, the surfaces are aligned within the scope of manufacturing tolerances if a maximum edge remains between them that does not hinder the insertion of the conductor in the conductor insertion direction. For example, the first or second inner side of the first or second bearing plate springs back relative to the first or second housing guide wall.

The first web of the contact arm can adjoin the first guide wall directly in the conductor insertion direction. Advantageously, the first bearing plate directly adjoins the first web in the conductor insertion direction. In an advantageous refinement, the second web of the contact arm adjoins the second guide wall directly in the conductor insertion direction. Advantageously, the second bearing plate directly adjoins the second web in the conductor insertion direction. Gaps between the guide wall and the web as well as between the web and the bearing plate are thus reduced. The risk of a single wire of a stranded wire getting caught in the remaining gaps is reduced.

A further aspect is a spring-clamp terminal block for connecting an electrical conductor, with a busbar and with a clamping spring and with a housing and with a lever. The lever has a first bearing plate with a first outer contour for mounting the lever in a first counter bearing. The lever has an actuation handle which is connected to the first bearing plate. The clamping spring has a clamping arm. The clamping arm together with the busbar forms a clamping point for clamping the electrical conductor on the busbar. The lever has a follower which is designed to move the clamping arm out of a closed position into an open position when the lever is pivoted. The first counter bearing is designed to absorb the force of the clamping spring. The lever has a first pin which projects axially from the first bearing plate and is disposed in a receptacle of the housing. The pin positions the lever when the follower is not in contact with the clamping arm of the clamping spring. In an advantageous refinement, the first counter bearing has a first section of the busbar and/or a first section of the clamping spring for absorbing the force of the clamping spring.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
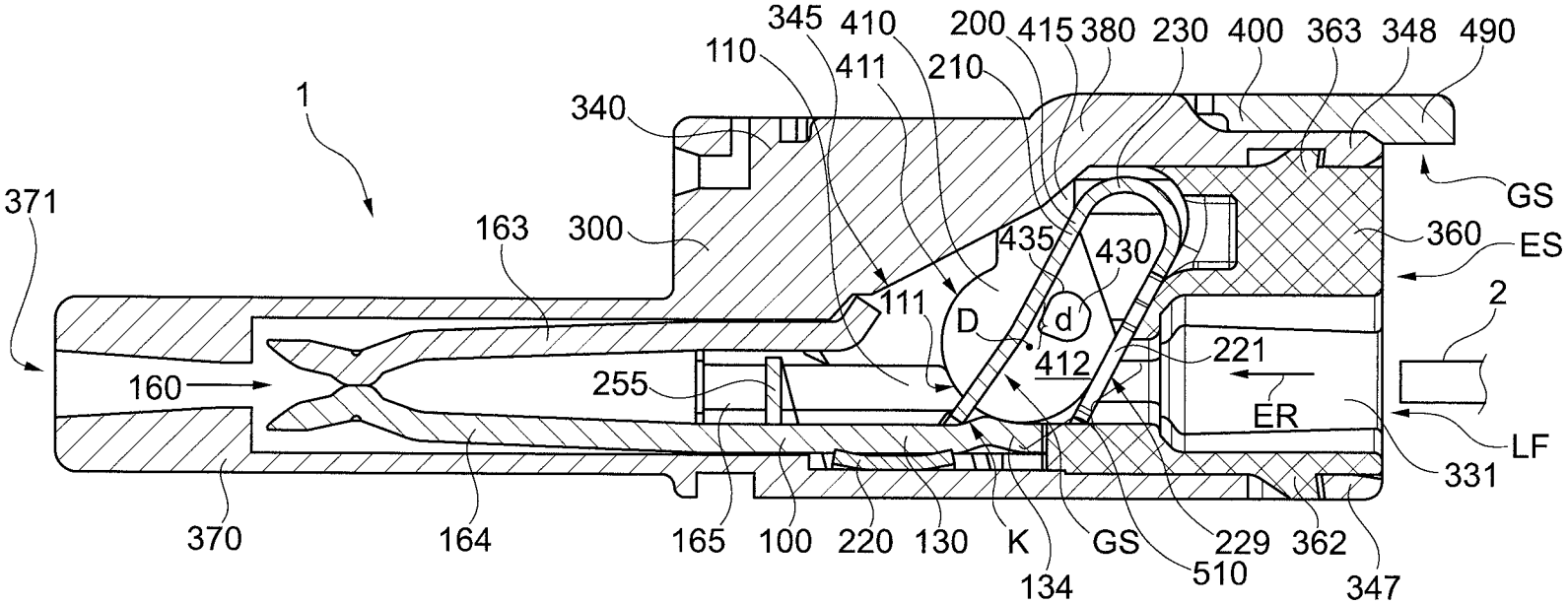
FIG. 1 shows an exemplary embodiment with a spring-clamp terminal block in a sectional view.

An exemplary embodiment with a spring-clamp terminal block 1 is shown schematically in a sectional view in FIG. 1. Spring-clamp terminal block 1 can also be referred to as a spring-loaded terminal block. A housing 300 is shown in which a busbar 100 and a lever 400 and a clamping spring 200 are accommodated. For electrical insulation, the electrically conductive components 100, 200 are preferably completely accommodated in housing 300 made of an insulating material, for example, plastic. If the spring-clamp terminal block is only approved for low voltage (up to 42 V), electrically conductive parts can protrude from housing 300. Lever 400 is partially accommodated in housing 300 and has an actuation handle 490 which protrudes from housing 300 for manual actuation.

Due to the sectional view, approximately through the middle of a conductor guide channel LF, lever 400 is shown partially covered by housing 300 in the view. Lever 400 has a first bearing plate 410 with a first partially circular outer contour 411 for mounting lever 400 in a first counter bearing 510. Actuation handle 490 is connected to first bearing plate 410 via a web 415 (shown partially hidden). First bearing plate 410 in the exemplary embodiment in FIG. 1 has the partially circular outer contour 411 with which first bearing plate 410 is mounted radially.

Clamping spring 200 has a clamping arm 210, which together with busbar 100 forms a clamping point K for clamping electrical conductor 2 on busbar 100. In the area of clamping point K, busbar 100 has a bulge 134 in order to increase the surface pressure and to minimize the electrical contact resistance. Lever 400 has a follower 430 which is designed to move clamping arm 210 out of a closed position GS into an open position OS when lever 400 is pivoted. In FIG. 1, lever 400 and clamping arm 210 are shown in the closed position GS. In contrast, lever 400 and clamping arm 210 are shown in the open position OS in FIG. 2.

Correspondingly, the clamping arm can be moved from the open position OS to the closed position GS by actuation lever 400. If an electrical conductor 2 is plugged in beforehand, clamping arm 210 encounters conductor 2 in the movement out of the open position OS and clamps this conductor 2 against busbar 100. If lever 400 is then moved further in the direction of the closed position GS, follower 430 loses contact with clamping arm 210, and the clamping force $F_{Spring}$ is then completely applied to conductor 2. Components 410, 415, 430, 490 of lever 400 are advantageously formed in one piece from plastic.

Figure 2:
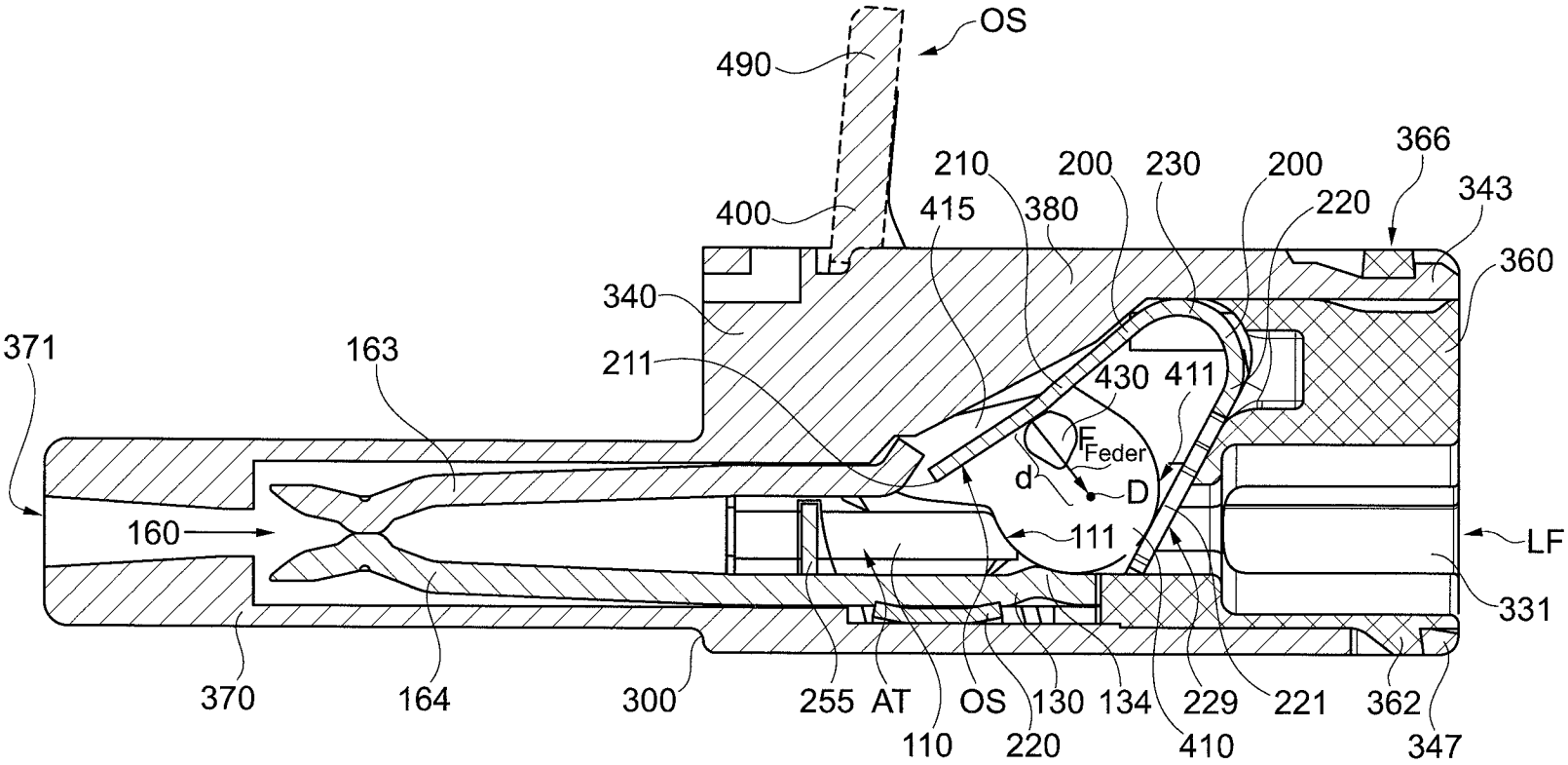
FIG. 2 shows the exemplary embodiment of FIG. 1 in the open position.

First bearing plate 410 is mounted radially in counter bearing 510. Counter bearing 510 in this case is formed in combination from at least one section of busbar 100 and at least one section of clamping spring 200. This enables the spring force $F_{Spring}$ introduced into bearing plate 410 via follower 430 to be transferred partly to busbar 100 and partly to clamping spring 200. In the exemplary embodiment in FIGS. 1 and 2, outer contour 411 of first bearing plate 410 slides on a bottom section 130 of busbar 100. Alternatively, or as shown in FIGS. 1 and 2 in combination, outer contour 411 slides on a busbar wall section 110 with a partially circular inner contour 111. The geometry of partially circular inner contour 111 of busbar wall section 110 is advantageously fitted to outer contour 411 of first bearing plate 410.

In the exemplary embodiment in FIG. 1, clamping spring 200 has clamping arm 210 and a contact arm 220 and a spring bend 230 connecting clamping arm 210 and contact arm 220. In the exemplary embodiment in FIG. 1, contact arm 220 extends from spring bend 230 to busbar 100 and further below busbar 100. Contact arm 220 in this case bears against busbar 100. Contact arm 220 of clamping spring 200 is advantageously located on the side of busbar 100 opposite clamping point K. FIG. 2 also shows that an extension 255 of contact arm 220 of clamping spring 200 is opened out and protrudes into an opening in the busbar to form a fastening point. At the same time, extension 255 of contact arm 220, which is formed as a tab, forms a wall that limits a maximum insertion depth of conductor 2.

Contact arm 220 of clamping spring 200 has an opening 229 which points toward the clamping point K. Conductor 2 is fed to the clamping point K through opening 229. Opening 229 is delimited by shown web 221 of contact arm 220, wherein first bearing plate 410 is mounted on web 221 of contact arm 220. Web 221 of contact arm 220 is thus part of first counter bearing 510. A housing wall 331 laterally delimits the conductor guide channel LF, so that a conductor 2, which is brought into the conductor connection terminal 1 from the insertion side ES, is laterally guided through housing wall 331, web 221 of contact arm 220, and inner side 412 of bearing plate 410, which are located one behind the other in the conductor insertion direction ER. Housing wall 331, web 221, and inner side 412 are advantageously designed and arranged such that no edge opposes conductor 2 in the insertion direction ER. In the ideal case, housing wall 331 and web 221 and inner side 412 are aligned in the conductor insertion direction ER.

In the exemplary embodiment in FIG. 1, spring-clamp terminal block 1 is designed for direct insertion of a solid conductor 2. To this end, it is not necessary to pivot lever 400 into the open position OS. When plugged in directly, conductor 2 is pushed in through conductor guide channel LF up to clamping arm 210 and deflects clamping arm 210 against the spring force $F_{Spring}$ by the feed force.

It is shown in the exemplary embodiment in FIG. 1 that in an area adjacent to spring bend 230, clamping arm 210 and contact arm 220 are arranged predominantly in parallel in the closed position GS. Clamping arm 210 deviates by less than 15° thereby from an exact mathematical parallelism from contact arm 220. As a result, it is possible to achieve a large clamping force by clamping spring 200 and at the same time a compact design.

In the exemplary embodiment in FIG. 1, housing 300 has a first housing part 340 and a second housing part 360 which are to be fastened to one another. First housing part 340 forms a base body 340 with an interior space 345. Busbar 100 and clamping spring 200 are accommodated in interior space 345. Second housing part 360 forms a cover 360. Cover 360 of housing 300 is accommodated in interior space 345, wherein cover 360 closes interior space 345. In the exemplary embodiment in FIG. 1, cover 360 has wall 331 of conductor guide channel LF. Cover 360 is fastened to base body 340 of housing 300 by fastening elements 361, 367. For example, fastening elements 361, 367 are designed for a positive fit.

In the exemplary embodiment in FIG. 1, lever 400 has an actuation handle 490 and a first web 415 and a second web 425, which are connected to actuation handle 490, so that an interspace is formed between the first web and the second web in which clamping arm 210 and a housing web 380 of first housing part 340 are disposed. Housing web 380 extends through the interspace.

In the exemplary embodiment in FIG. 1, housing web 380 has a fastening element 348 for fastening to second housing part 360, i.e., cover 360. Fastening element 348 of housing web 380 is designed as an undercut 348, which is assigned a latching hook 363 of cover 360.

In the exemplary embodiment in FIG. 2, housing web 380 has a fastening element 343 for fastening to cover 360. Fastening element 343 of housing web 380 is designed as a latching hook 343. Cover 360 has an undercut 366 that fits latching hook 343. In both exemplary embodiments, fastening elements 361, 362 are designed as latching elements or associated edges. In both cases, housing web 380 passes through the interspace between first web 415 and second web 425 of lever 400. Likewise, clamping arm 210 of clamping spring 200 extends through the interspace between first web 415 and second web 425. A number of advantages are achieved by this design. It is made possible to provide a particularly large travel path for lever 400, so that the actuation force experienced by the user can be kept low due to the transmission ratio. At the same time, spring-clamp terminal block 1 can be made especially small. The interspace between webs 415, 425 and bearing plates 410, 420 at the free ends of webs 415, 425 is used synergistically by housing web 380, clamping arm 210, and follower 430 in a very small space, so that a particularly compact configuration can be achieved.

The exemplary embodiment in FIG. 2 shows that housing web 380 in the area of clamping spring 200 has a thickness that ensures a distance of at least 1.3 mm between clamping spring 200 and a contactable outer surface of housing 300. Sufficient clearance and creepage distances are achieved by the 1.3 mm.

In the exemplary embodiment in FIG. 1, busbar 100 has, in addition to bottom section 130, which acts as a contact section, a bifurcated contact 160 with a first prong 163 and a second prong 164. First prong 163 and second prong 164 are fixedly connected to one another by a connecting wall 165. Bottom section 130, first and second prongs 163, 164, and connecting wall 165 are advantageously formed in one piece from a piece of metal, for example, by punch bending. Bifurcated contact 160 is disposed in a plug-in face 370 of housing 300. Plug-in face 370 has an opening 371, leading to bifurcated contact 160, for a contact blade. As an alternative to the exemplary embodiment in FIG. 1, spring-clamp terminal block 1 can have a contact blade which is formed in one piece with bottom section 130 of busbar 100.

In FIG. 2, lever 400 and clamping arm 210 are shown in the open position OS in the sectional view. Clamping arm 210 is deflected in the open position OS. The spring force $F_{Spring}$ acts on the follower and is approximately directed through the pivot point D. The pivot point D is defined here by partially circular outer contour 411 of first bearing plate 410. As a result, in the exemplary embodiment in FIG. 2, lever 400 is held in a position past dead center.

In the exemplary embodiments in FIGS. 1 and 2 of spring-clamp terminal block 1, first partially circular outer contour 411 of first bearing plate 410 defines an axis of rotation D of lever 400 when lever 400 is pivoted out of the closed position GS into the open position OS. Follower 430 has a curved surface 435 such that when lever 400 is pivoted, the distance d of the region of surface 435, in contact with clamping arm 210, to the axis of rotation D changes. In this regard, the distance d is greater in the open position OS than in the closed position GS.

In FIG. 2, follower 430 is positioned closer to the free end of clamping arm 210 in the open position OS than in the closed position GS in FIG. 1. Accordingly, with the deflection of clamping arm 210 of clamping spring 200, the spring force $F_{Spring}$ increases; at the same time, a lever arm length between the contact area of follower 430 with clamping arm 210 and spring bend 230 also increases. Both effects partially compensate, so that the user experiences a smaller increase in lever actuation force at actuation handle 490 when pivoting. At the end of the pivoting movement, lever 400 falls into the open position OS.

At the free end of clamping arm 210, a clamping edge 211 is formed, which is positioned toward an incline of the busbar, so that a conductor 2 is fed into the conductor-retaining pocket AT, formed by busbar 100 and tab 255, first by clamping arm 210 and immediately thereafter by busbar 100. At the same time, conductor 2 is guided in the insertion direction ER also oppositely on the bottom by bottom section 130 of busbar 100 and additionally laterally. Multi-wire conductors or stranded wires with many individual conductors can also be connected by the guiding using spring-clamp terminal block 1.

Figure 3A:
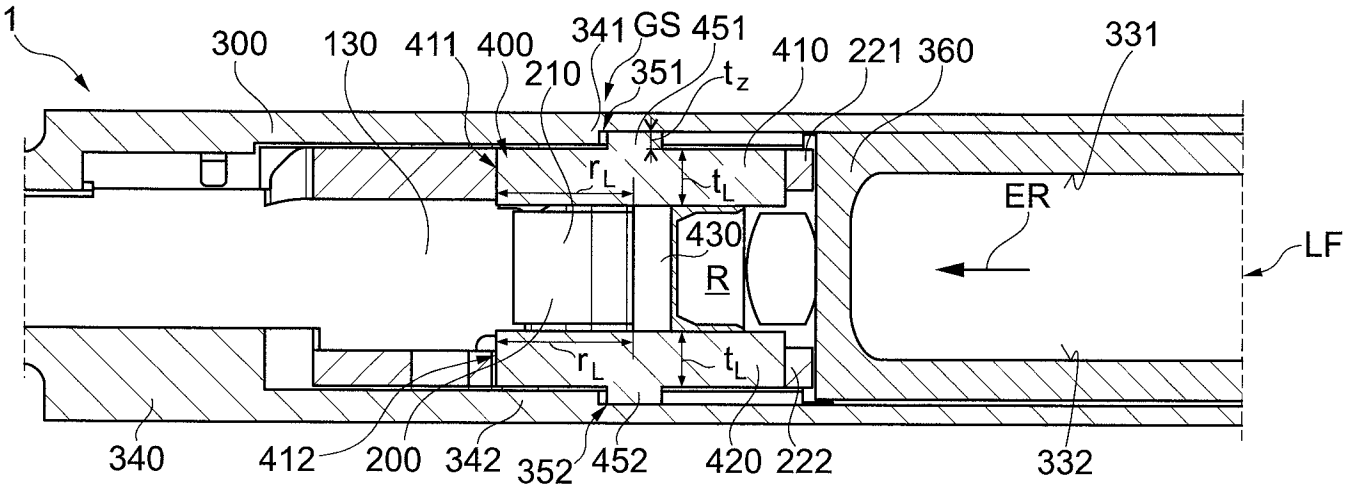
FIGS. 3*a* and 3*b* show sectional views of an exemplary embodiment of a spring-clamp terminal block.
Figure 3B:
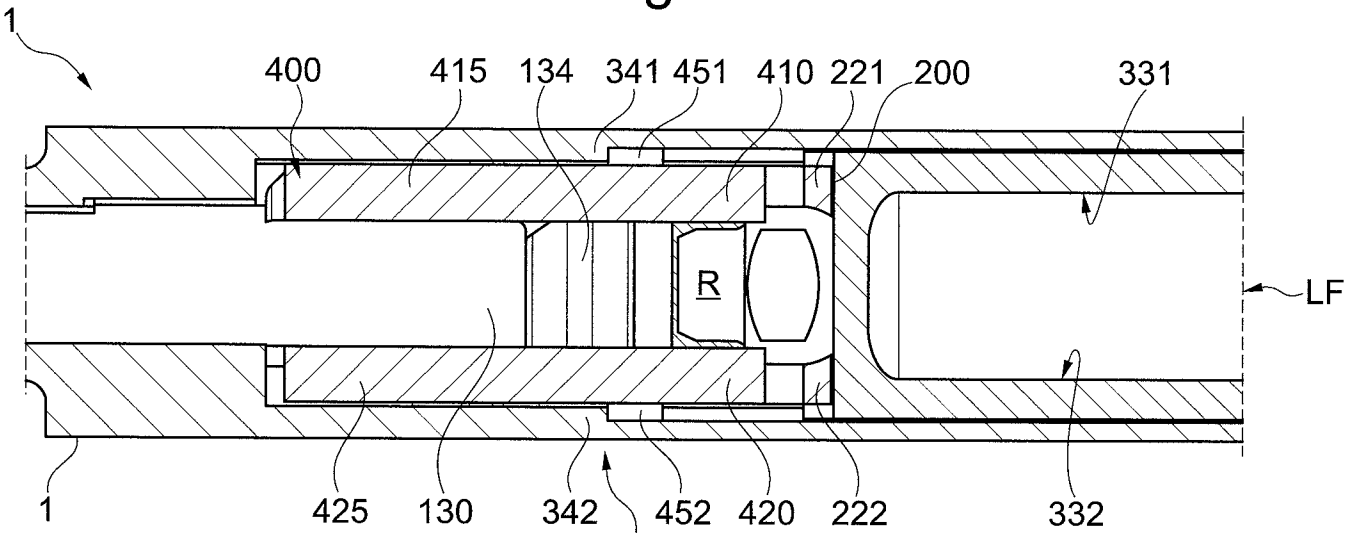

An exemplary embodiment provides a lever 400 that has two bearing plates. As a result, bearing forces are reduced and tilting of lever 400 is also reduced. A lever 400 with a first bearing plate 410 and a second bearing plate 420 is shown in the exemplary embodiment in FIGS. 3*a* and 3*b* in a horizontal section. In this case, FIG. 3*a* shows the lever in the closed position GS and FIG. 3*b* shows lever 400 in the open position OS. First bearing plate 410 is connected to a follower 430. Second bearing plate 420 is connected to follower 430. First bearing plate 410 and second bearing plate 420 are advantageously connected to one another by follower 430. As a result, the stability of lever 400 can be increased in particular for a smaller lever 400. Alternatively, follower 430 is formed in two parts. In this case, follower 430 is, for example, partially molded onto first bearing plate 410 and partially onto second bearing plate 420. First bearing plate 410 and second bearing plate 420 and follower 430 are advantageously formed in one piece from one material. Bearing plates 410, 420 are advantageously made of plastic. Alternatively, it is possible to make the follower as a separate element, for example, as a cotter pin or mandrel. For example, the follower is made from a metal.

It can be seen in FIG. 3*b* that first bearing plate 410 is connected to a first web 415 and second bearing plate 420 to a second web 425. Both webs 415, 425 are connected to the actuation handle (not visible in the section), so that lever 400 forms a U-shape, on the free ends of which bearing plates 410, 420 are formed. First bearing plate 410 is mounted in a first counter bearing made from bottom section 130 of busbar 100 and a first web 221 of contact arm 220. Second bearing plate 420 is mounted in a second counter bearing made from bottom section 130 of busbar 100 and a second web 222 of contact arm 220.

A space R for conductor 2 is formed between a first interior side 412 of first bearing plate 410 and a second interior side 422 of second bearing plate 420. In the closed position GS, as shown in FIG. 3*a*, this space R is delimited by clamping arm 210. In the open position OS according to FIG. 3*b*, the space R is further laterally delimited by webs 415, 425. Conductor 2 inserted in the open position OS reaches bulge 134 and can be securely clamped to bulge 134. Alternatively, it is possible to form a bulge at another location or a corrugated bottom section or a plurality of bulges.

First bearing plate 410 is axially supported by a first housing wall 341. Second bearing plate 420 is axially supported by a second housing wall 342. First bearing plate 410 is radially supported in the first counter bearing by means of first partially circular outer contour 411, wherein the first counter bearing is designed to absorb the force of clamping spring 200. Lever 400 has a first pin 451 projecting axially from first bearing plate 410. First pin 451 is disposed in a first receptacle 351 of housing 300. Lever 400 is supported positioned by first pin 451 during pivoting when follower 430 is not in contact with clamping arm 210 of clamping spring 200. If, in contrast, follower 430 bears against clamping arm 210, the force of clamping spring 200 is transmitted to the first counter bearing via follower 430 and first bearing plate 410. Receptacle 351 has, for example, a slight play so that the force of clamping spring 200 does not predominantly act on pin 451 and receptacle 351. Pin 451 and receptacle 351 ensure that lever 400 is not loosely movable in housing 300 out of contact with clamping spring 200 but is held in position by pin 451 and receptacle 351. These two matched supports for first bearing plate 410 can effectively prevent lever 400 from wobbling out of contact with clamping spring 200; at the same time, good support at a high spring force is ensured and clamping spring 200 can still have a simple design.

In fact, a first pin 451 on first bearing plate 410 is sufficient for the positioning, so that no second pin on second bearing plate 420 is required. However, if both bearing plates 410, 420 are formed with pins 451, 452, the risk of lever 400 tipping over can be further reduced. In this regard, lever 400 has second pin 452 projecting axially from second bearing plate 420. Second pin 452 is disposed in a second receptacle 352 of housing 300. Second pin 452 positions lever 400 during pivoting when follower 430 is not in contact with clamping arm 210 of clamping spring 200. If, in contrast, follower 430 bears against clamping arm 210, the force of clamping spring 200 is transmitted to the second counter bearing via follower 430 and second bearing plate 420. Receptacle 352 has, for example, a slight play so that the force of clamping spring 200 does not predominantly, ideally not at all, act on pin 452 and receptacle 352. Pin 452 and receptacle 352 ensure that lever 400 is not loosely movable in housing 300 out of contact with clamping spring 200 but is held in position by pin 452 and receptacle 352. These two matched supports for second bearing plate 420 can effectively prevent a loose lever 400 out of contact with clamping spring 200; at the same time, good support by the second counter bearing at a high spring force in contact with clamping spring 200 is ensured and clamping spring 200 can still have a simple design.

It is shown in the exemplary embodiments in FIGS. 3*a* and 3*b* that housing 300 has a first guide wall 331 and/or a second guide wall 332 of a conductor guide channel LF. The conductor guide channel LF guides the electrical conductor to the clamping point K. For this purpose, the electrical conductor is to be pushed from the outside into an opening for the conductor and through the conductor guide channel in the conductor insertion direction ER. First guide wall 331 and/or a second guide wall 332 are formed, for example, in a cover 360 of housing 300. Advantageously, first guide wall 331 is continued by first bearing plate 410 for guiding the conductor, wherein in the exemplary embodiment in FIG. 3*a*, first web 221 of contact arm 220 is disposed between first guide wall 331 and first bearing plate 410. Advantageously, second guide wall 332 is continued by second bearing plate 420 for guiding the conductor, wherein in the exemplary embodiment in FIG. 3*a*, second web 222 of contact arm 220 is disposed between second guide wall 332 and second bearing plate 420. After being guided by first guide wall 331 and second guide wall 332, the conductor exits through opening 229 in contact arm 220 into the space R between bearing plates 410, 420. Furthermore, bottom section 130 of busbar 100 and oppositely clamping arm 210 of clamping spring 200 can contribute to the guiding.

Figure 4:
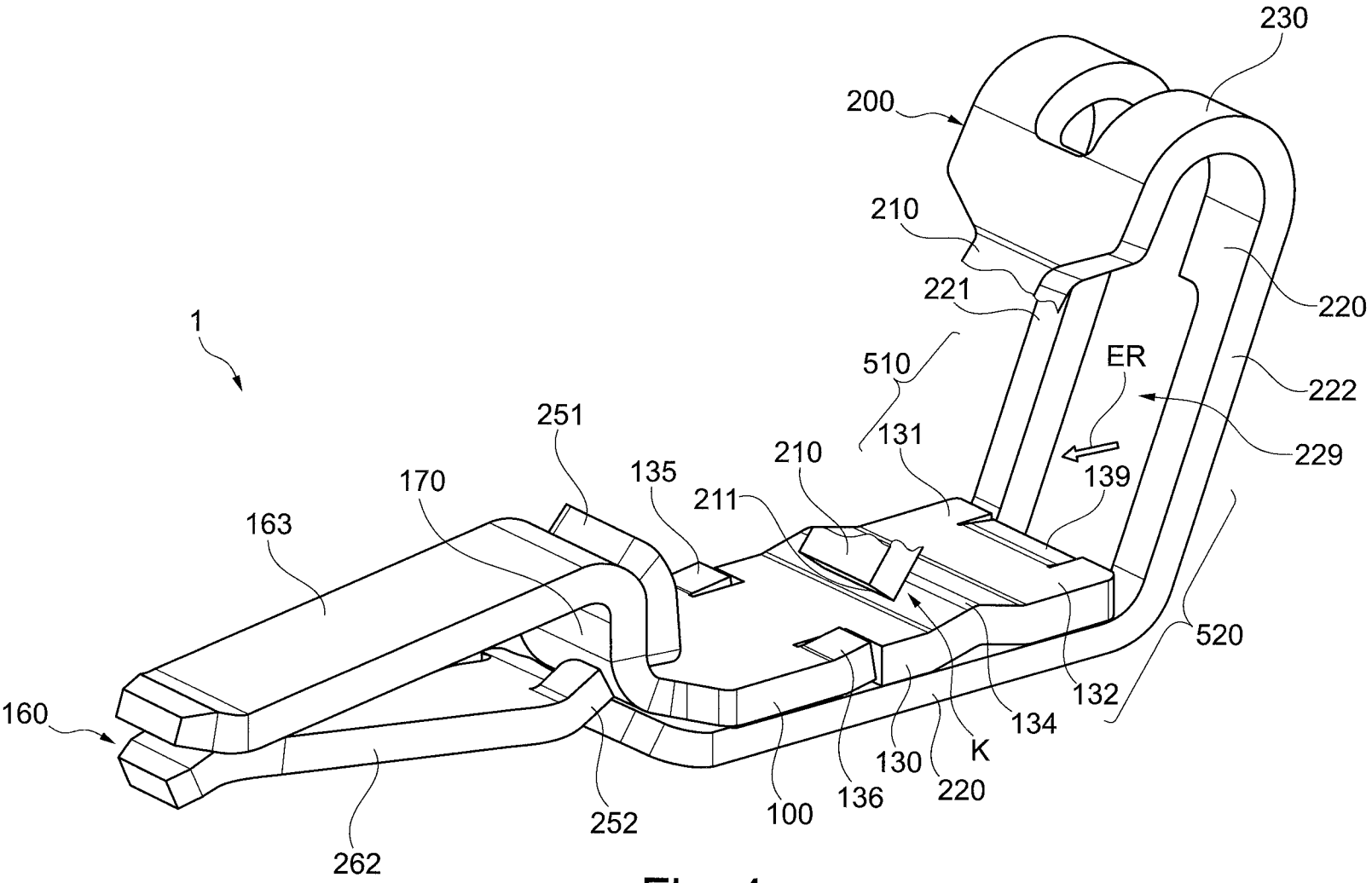
FIG. 4 shows an exemplary embodiment of a contact insert of a spring-clamp terminal block.

A contact insert of an exemplary embodiment of a spring-clamp terminal block 1 is shown in a three-dimensional view in FIG. 4. For a view of a first counter bearing 510, a clamping arm 210 of a clamping spring 200 is shown interrupted. In reality, this clamping arm 210 of clamping spring 200 is of course designed to be continuous. A busbar 100 and clamping spring 200 of spring-clamp terminal block 1 are shown. A lever for moving clamping arm 210 is not shown in the exemplary embodiment in FIG. 4. A housing for receiving the contact insert can, if necessary, be added in the exemplary embodiment in FIG. 4.

Clamping spring 200 has a spring bend 230 and a contact arm 220 and clamping arm 210. Clamping spring 200 is advantageously formed in one piece from a spring steel and bent. Clamping spring 200 is optimized to permanently ensure a pressure force of an electrical conductor on busbar 100. Clamping arm 210 is connected via the spring bend 230 to contact arm 220. In the exemplary embodiment in FIG. 4, clamping spring 200 has exactly one clamping arm 210 for an electrical conductor. Furthermore, the contact insert of the exemplary embodiment in FIG. 4 has a bifurcated contact 160. Contact arm 220 of clamping spring 200 forms a prong 262 of bifurcated contact 160.

The contact insert of the exemplary embodiment in FIG. 4 also has busbar 100. Busbar 100 is advantageously made of metal, for example, galvanized copper, which is optimized for the electrical conductivity under defined environmental conditions. Alternatively, busbar 100 is produced from a copper alloy or another metal. Busbar 100 is advantageously refined, in particular silver-plated or gold-plated. Busbar 100 has a bottom section 130, which can also be referred to as a contact section 130. In the exemplary embodiment in FIG. 4, bottom section 130 has a bulge 134 on the contact side, which together with a clamping edge 211 of clamping arm 210 forms a contact point K for the electrical conductor. Busbar 100 has a connecting section 170, which is formed predominantly perpendicular to bottom section 130, and a prong 163 of bifurcated contact 160. Correspondingly, busbar 100 has first prong 163 of a bifurcated contact 160. Clamping spring 200, in contrast, has second prong 262 of bifurcated contact 160. In this case, second prong 262 of clamping spring 200 bears against first prong 163 of bifurcated contact 160 under preload.

Prong 163 of busbar 100 is connected to bottom section 130 via connecting section 170. In the exemplary embodiment in FIG. 4, connecting section 170 of busbar 100 is predominantly perpendicular to first prong 163. If a blade contact is connected in bifurcated contact 160 and an electrical conductor is connected to the clamping point K, a current can flow into the blade contact from the electrical conductor via bottom section 130 and via connecting section 170 and via prong 163. Bottom section 130 and connecting section 170 and prong 163 of busbar 100 are preferably formed in one piece from a piece of metal.

In the exemplary embodiment in FIG. 4, a spring-clamp terminal block 1 is shown with a first counter bearing 510 for a first bearing plate and/or a second counter bearing 520 for a second bearing plate. In this case, only first counter bearing 510 or second counter bearing 520 can be formed, but both counter bearings 510, 520 are particularly advantageously provided for secure mounting.

First counter bearing 510 has a first bearing shell 510, which is formed at least from a first section 131 of busbar 100 and a first section 221 of a contact arm 220 of clamping spring 200. First section 131 of busbar 100 is formed in bottom region 130 of busbar 100. First section 131 of busbar 100 has a flat surface for mounting. Alternatively, the surface is curved in accordance with the first bearing plate in order to enlarge the bearing surface. An independent inventive aspect provides that bulge 134 is positioned for the contact point K such that first section 131 of busbar 100 extends into bulge 134, so that the first bearing plate is also supported on bulge 134.

In the exemplary embodiment of FIG. 4, it is provided that first section 131 of busbar 100 and first section 221 of contact arm 220 are arranged at an obtuse angle to form first bearing shell 510. For example, the angle is in a range from 90° to 140°, in particular in a range from 100° to 120°.

In the exemplary embodiment in FIG. 4, contact arm 220 of clamping spring 200 has a first web 221. First web 221 delimits an opening 229 in contact arm 220. First web 221 forms a support for the first bearing plate of a lever. Thus, first web 221 is part of first counter bearing 510. Advantageously, first web 221 has a width that is adapted to a width of first section 131 of busbar 100.

Second counter bearing 520 has a second bearing shell 520, which is formed at least from a second section 132 of busbar 100 and a second section 222 of a contact arm 220 of clamping spring 200. Second section 132 of busbar 100 is formed here in bottom region 130 of busbar 100. Second section 132 of busbar 100 has a flat surface for support. Alternatively, the surface is curved in accordance with the second bearing plate in order to enlarge the bearing surface. An independent inventive aspect provides that bulge 134 is positioned for the contact point K such that second section 132 of busbar 100 extends into bulge 134, so that the second bearing plate is also supported on bulge 134. Advantageously, the main extension directions of first section 131 and second section 132 of busbar 100 are made essentially parallel to one another.

In the exemplary embodiment of FIG. 4, it is provided that second section 132 of busbar 100 and second section 222 of contact arm 220 are arranged at an obtuse angle to form second bearing shell 520. For example, the angle is in a range from 90° to 140°, in particular in a range from 100° to 120°.

In the exemplary embodiment in FIG. 4, contact arm 220 of clamping spring 200 has a second web 222. Second web 222 delimits an opening 229 in contact arm 220. Second web 222 forms a support for the second bearing plate of a lever. Thus, second web 222 is part of second counter bearing 520. Advantageously, second web 222 has a width that is adapted to a width of second section 132 of busbar 100.

In principle, only first web 221 or only second web 222 could be formed. However, first web 221 and second web 222 are advantageously formed together. First web 221 and second web 222 are advantageously formed substantially parallel.

In the exemplary embodiment of spring-clamp terminal block 1 in FIG. 4, contact arm 220 of clamping spring 200 has an opening 229 for feeding the electrical conductor through opening 229 to the clamping point K. FIG. 4 shows that webs 221, 222 delimit opening 229. In the exemplary embodiment of spring-clamp terminal block 1 in FIG. 4, opening 229 extends into spring bend 230. In the exemplary embodiment of spring-clamp terminal block 1 in FIG. 4, opening 229 extends to below busbar 100. The geometry of opening 229 enables, for example, an actuation element to pass through opening 229 in order to deflect clamping arm 210 to open. For example, the actuation element is a pusher or plunger or lever of spring-clamp terminal block 1. Opening 229 also enables actuation by an external actuation tool. Alternatively, it is possible for a web of an insulating material housing to pass through opening 229 in order to achieve greater stability.

In the exemplary embodiment of spring-clamp terminal block 1 in FIG. 4, clamping spring 200 is mounted on busbar 100. Due to this mounting, busbar 100 and clamping spring 200 can be preassembled and suitable for handling in bulk. Contact arm 220 of clamping spring 200 extends along the side of bottom section 130 of busbar 100, said side being opposite contact point K, and bears against bottom section 130 of busbar 100 on the side opposite contact point K. At contact point K, clamping arm 210 bears with a preload against bottom section 130 of busbar 100, so that bottom section 130 is gripped between clamping arm 210 and contact arm 220.

In the exemplary embodiment of spring-clamp terminal block 1 in FIG. 4, clamping spring 200 is supported on connecting section 170. Clamping spring 200 is advantageously supported on connecting section 170 on both sides of connecting section 170. The support on both sides reliably prevents that busbar 100 can be displaced relative to clamping spring 200 in its main direction of extension, in particular in the insertion direction of the conductor ER or against the insertion direction of the conductor ER. Clamping spring 200 advantageously has a first bearing element 251 for support on a side of connecting section 170, said side facing clamping point K, and/or a second bearing element 252 for support on a side of connecting section 170, said side facing away from clamping point K. First bearing element 251 and second bearing element 252 are advantageously formed in one piece with contact arm 220, for example, from spring steel.

Figure 5:
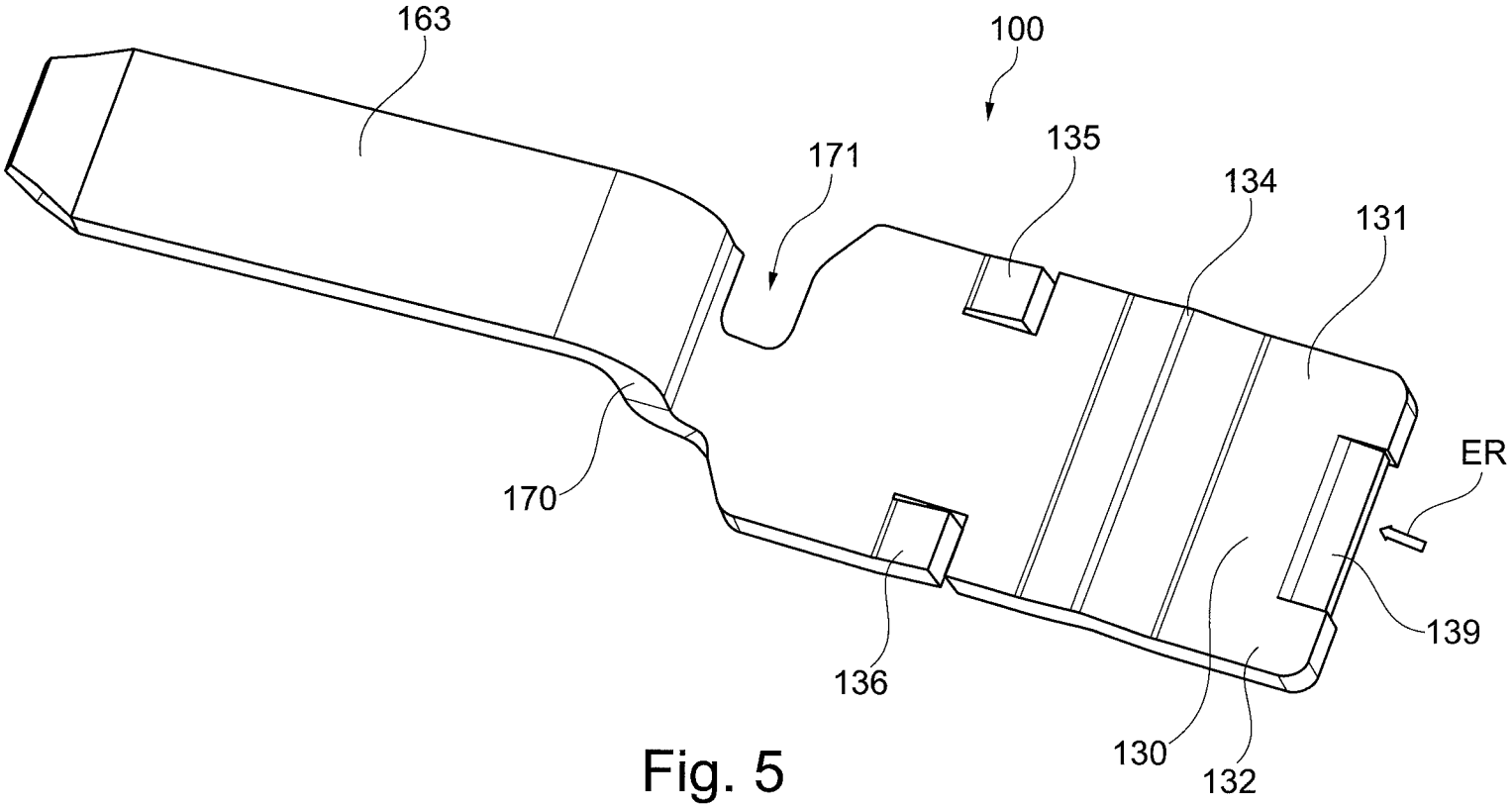
FIG. 5 shows an exemplary embodiment of a busbar of a spring-clamp terminal block.

An exemplary embodiment with a busbar 100 is shown in a three-dimensional view in FIG. 5. Busbar 100 has two fastening elements 135, 136 which can be used when busbar 100 is to be fastened in a housing, in particular in an insulating plastic housing. The two fastening elements 135, 136 form, for example, latching elements which latch behind an edge of the housing or which insert into the plastic of the housing. Busbar 100 has an indentation 171 in the region of connecting section 170, into which an element of clamping spring 200 (for example, bearing element 251 in FIG. 4 or FIG. 6) engages, so that busbar 100 and clamping spring 200 are connected in a positive-locking manner. In the conductor insertion direction ER, a conductor first encounters an incline 139 of busbar 100, so that the conductor does not encounter any edge in the insertion direction ER on which the conductor or individual wires of the conductor could get caught. Incline 139 is formed by cutting out and reshaping a short tab 139 that is bent into opening 229. Busbar 100 is additionally supported by tab 139 relative to contact arm 220 of clamping spring 200, so that busbar 100 cannot be moved in the area of tab 139 relative to contact arm 220 transversely to the conductor insertion direction ER. Busbar 100 engages with tab 139 in opening 229 and creates anti-rotation protection, so that the contact insert comprising busbar 100 and clamping spring 200 can be preassembled in bulk.

Figure 6:
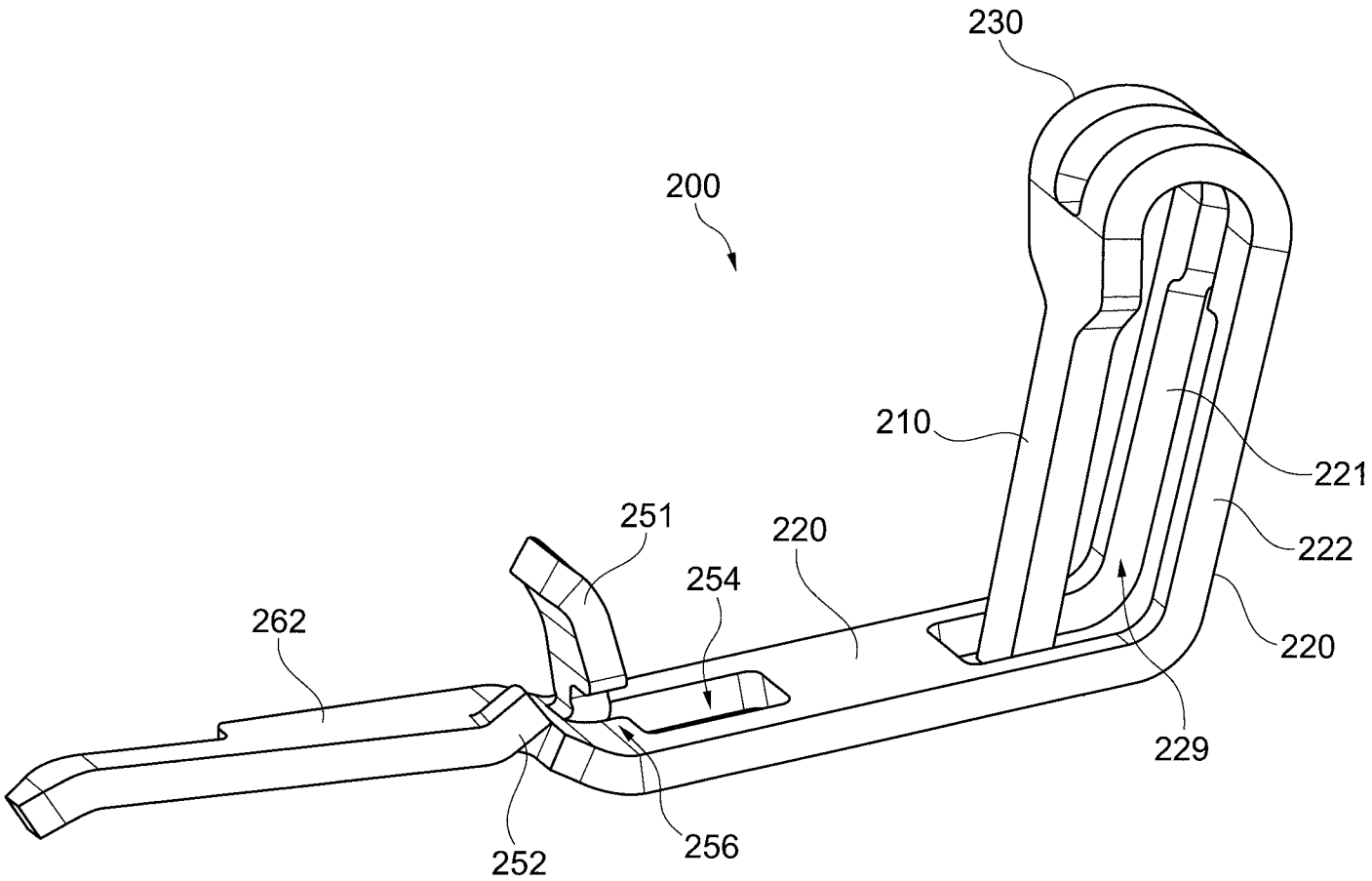
FIG. 6 shows an exemplary embodiment of a clamping spring of a spring-clamp terminal block with a relaxed clamping arm.
Figure 7:
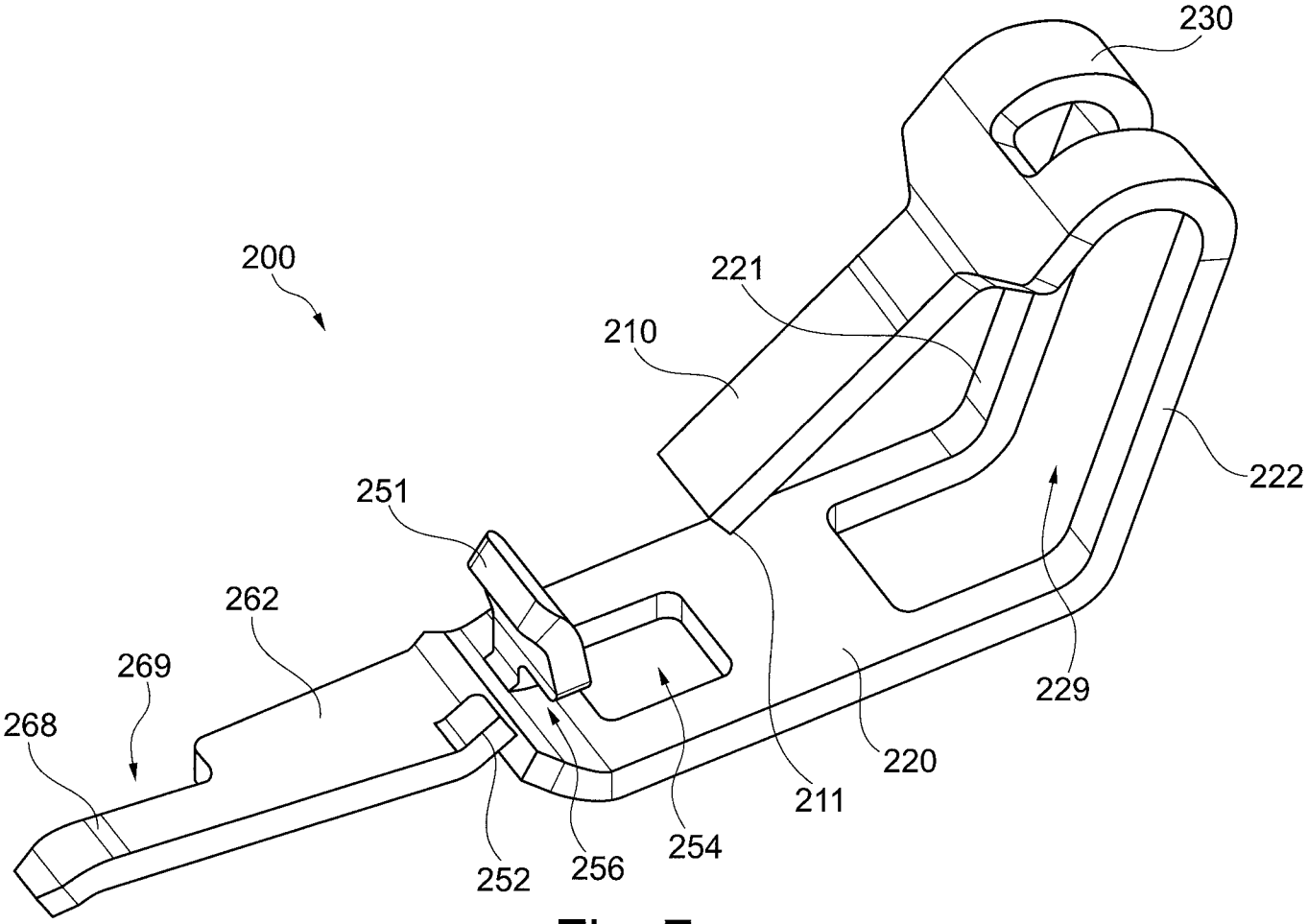
FIG. 7 shows an exemplary embodiment of a clamping spring of a spring-clamp terminal block with a deflected clamping arm.

An exemplary embodiment of a clamping spring 200 of a spring-clamp terminal block with a relaxed clamping arm 210 is shown in a three-dimensional view in FIG. 6. FIG. 6 shows that opening 229 extends into the horizontal section of contact arm 220. Opening 229 is configured such that clamping arm 210 extends into opening 229 in the neutral state. To assemble busbar 100 from FIG. 5, clamping arm 210 would first have to be deflected, as shown in FIG. 7. Busbar 100 would then be pushed laterally onto contact arm 220 of clamping spring 200. In this case, a curvature 256 of contact arm 220 of clamping spring 200 and indentation 171 of busbar 100 from FIG. 5 intermesh. If clamping arm 210 is then released, clamping arm 210 presses on bottom section 130 of busbar 100, as shown in FIG. 4. The exemplary embodiment in FIG. 6 shows that bearing element 251 is punched out and bent out of contact arm 220, as a result of which the further opening 254 forms in contact arm 220.

In the exemplary embodiment in FIG. 7, prong 262 of clamping spring 200 in contact area 268 is narrowed to approximately half the width by an indentation 269, so that two contact areas 268 of two clamping springs 200 can be positioned next to one another, so that the contact area of the other spring is positioned in indentation 269.

Figure 8:
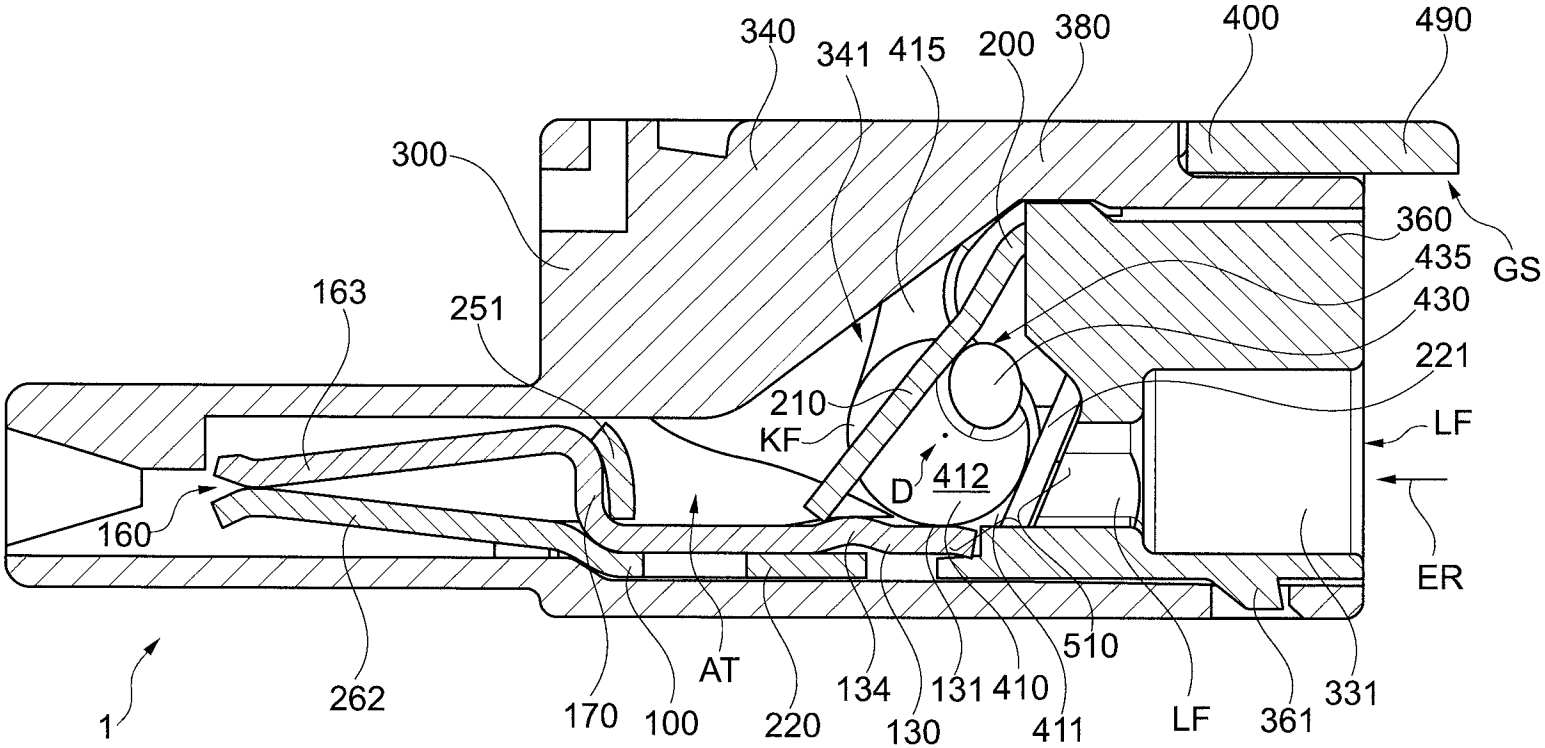
FIG. 8 shows an exemplary embodiment with a spring-clamp terminal block in a sectional view.

FIG. 8 shows an exemplary embodiment of a spring-clamp terminal block 1 for connecting an electrical conductor in a sectional view. For the connection, the conductor is inserted into spring-clamp terminal block 1 in the insertion direction ER. Spring-clamp terminal block 1 has a busbar 100 and a clamping spring 200 and a housing 300 and a lever 400. Busbar 100 and clamping spring 200 form a contact insert for the electrical connection of the conductor to busbar 100.

Figure 9:
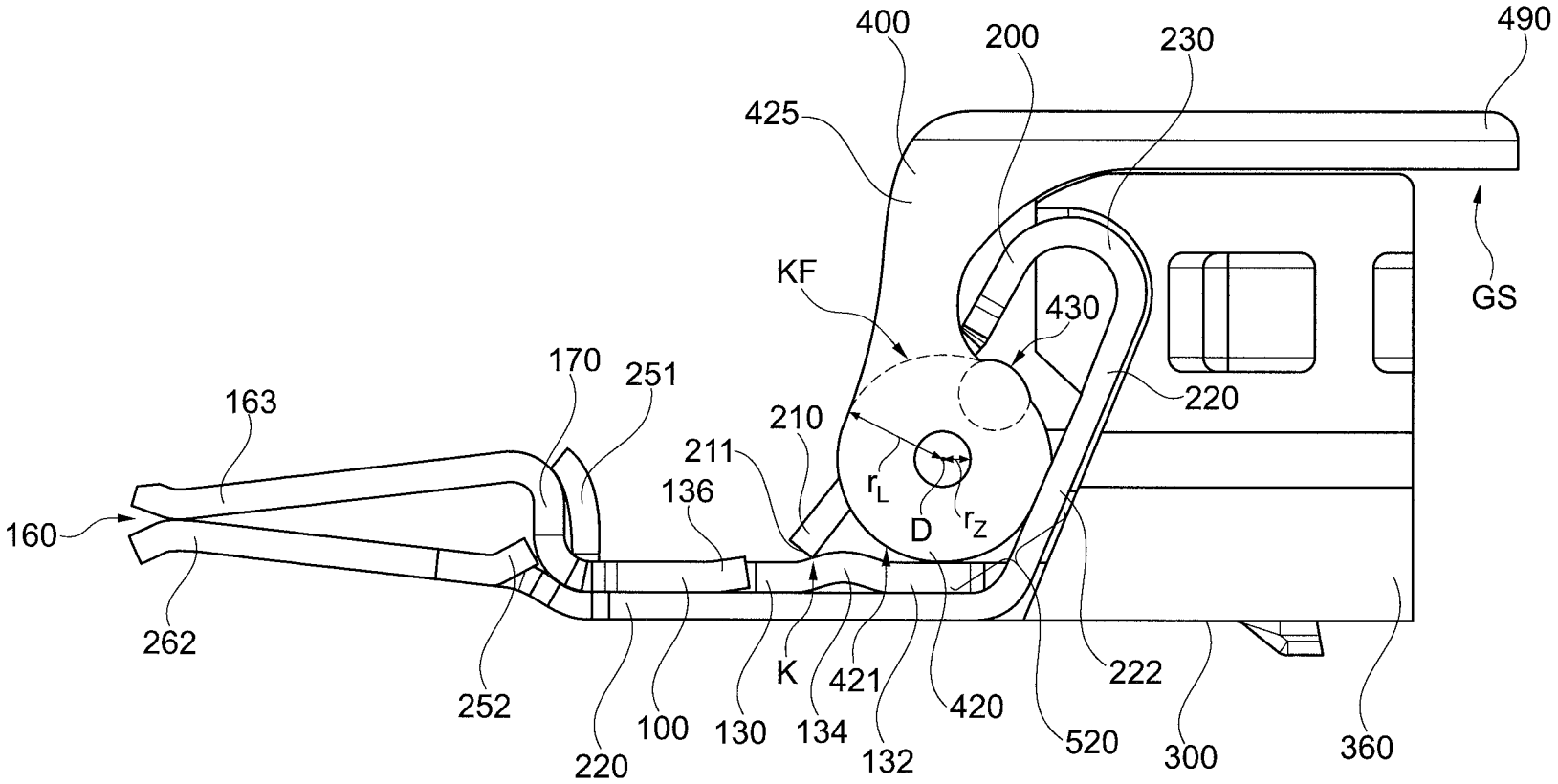
FIG. 9 shows an exemplary embodiment with a spring-clamp terminal block in a side view.

In the exemplary embodiment in FIG. 8, busbar 100 and clamping spring 200 and partly lever 400 are accommodated in housing 300. FIG. 9 shows an exemplary embodiment with parts of a spring-clamp terminal block 1 in a side view, wherein a part of housing 300 is omitted to be able to see lever 400 and clamping spring 200 and busbar 100.

Lever 400 has a first bearing plate 410 with a first partially circular outer contour 411 for mounting lever 400 in a first counter bearing 510. First bearing plate 410, first partially circular outer contour 411, and first counter bearing 510 are shown in FIG. 8. Lever 400 has a second bearing plate 420 with a second partially circular outer contour 421 for mounting lever 400 in a second counter bearing 520. Second bearing plate 420, second partially circular outer contour 421, and second counter bearing 520 are shown in FIG. 9. The exemplary embodiments of FIGS. 8 and 9 are different but can be combined with one another. In this case, second bearing plate 420 is spaced from first bearing plate 410. A part of clamping arm 210 of clamping spring 200, which is shown in section in FIG. 8, is disposed between first bearing plate 410 and second bearing plate 420.

Lever 400 has an actuation handle 490, which in the exemplary embodiment in FIG. 8 is connected to first bearing plate 410 via first web 415 and in the exemplary embodiment in FIG. 9 to second bearing plate 420 via second web 425. Clamping spring 200 has clamping arm 210 and a spring bend 230 and a contact arm 220. Clamping arm 210 together with busbar 100 forms a clamping point K for clamping the electrical conductor on busbar 100. Lever 400 has a follower 430 which is designed to move clamping arm 210 out of a closed position GS into an open position when lever 400 is pivoted. The closed position GS is shown in each of the exemplary embodiments in FIGS. 8 and 9. Advantageously, lever 400 can also be used to move from the open position back to the closed position GS. In the closed position GS, clamping arm 210 is predominantly parallel to contact arm 220 in the area adjacent to spring bend 230. In this regard, clamping arm 210 and contact arm 220 are then predominantly parallel if a deviation from a mathematical parallelism is less than 15°, in particular less than 10°. In this way, a compact arrangement of lever 400, spring clamp 200, and busbar 100 can be achieved. In the exemplary embodiment shown in FIG. 8, clamping arm 210 bears with a preload against a bottom region 130 of busbar 100. This makes it possible to securely clamp conductors with a small cross section.

In the exemplary embodiment of FIG. 8, first counter bearing 510 has a first bearing shell 510, which is formed at least from a first section 131 of busbar 100 and a first section 221 of contact arm 220 of clamping spring 200. Advantageously, both first sections 131, 221 form an obtuse angle in which, as shown in FIG. 8, first bearing plate 410 is accommodated. First bearing plate 410 touches first section 131 of busbar 100 at least in a linear manner. The bearing surface in first section 131 can be enlarged by a curvature in first section 131 of busbar 100. First bearing plate 410 touches first section 221 of contact arm 220 at least in a linear manner. The bearing surface in first section 221 can be enlarged by a curvature in first section 221 of contact arm 220.

In the exemplary embodiment of FIG. 9, second counter bearing 520 has a second bearing shell 520, which is formed at least from a second section 132 of busbar 100 and a second section 222 of contact arm 220 of clamping spring 200. Advantageously, both second sections 132, 222 form an obtuse angle in which, as shown in FIG. 9, second bearing plate 420 is accommodated. Second bearing plate 420 touches second section 132 of busbar 100 at least in a linear manner. The bearing surface in second section 132 can be enlarged by a curvature in second section 132 of busbar 100. Second bearing plate 420 touches second section 222 of contact arm 220 at least in a linear manner. The bearing surface in second section 222 can be enlarged by a curvature in second section 222 of contact arm 220.

A combinable independent inventive aspect is shown in the exemplary embodiments in FIGS. 8 and 9. Lever 400 has a follower 430 which is designed to move clamping arm 210 out of a closed position GS into an open position when lever 400 is pivoted. In the exemplary embodiments in FIGS. 8 and 9, follower 430 is designed as a strut 430 which is disposed between first bearing plate 410 and second bearing plate 420. Strut 430 connects first bearing plate 410 to second bearing plate 420. Possible tilting of bearing plates 410, 420 is reduced thereby when the spring force from clamping arm 210 acts on bearing plates 410, 420 via follower 430. In this case, bearing plates 410, 420 can be made thinner, for example, so that a compact spring-clamp terminal block 1 is achieved.

In the exemplary embodiments in FIGS. 8 and 9, follower 430 and first bearing plate 410 and second bearing plate 420 are formed in one piece from a plastic. For example, the entire lever 400 is molded in one piece from a plastic. Follower 430 is shaped such that it extends predominantly parallel to an axis of rotation D. The axis of rotation D is defined by first partially circular outer contour 411 of first bearing plate 410 or by second partially circular outer contour 421 of second bearing plate 420. The respective partially circular outer contour 411, 421 in this case defines a circular shape KF, the center of which is the axis of rotation D.

The exemplary embodiment in FIG. 8 shows that follower 430 is at least partially disposed within the circular shape KF of second bearing plate 420. The exemplary embodiment in FIG. 8 shows that follower 430 is at least partially disposed within the circular shape KF of first bearing plate 410. In the exemplary embodiment in FIG. 8, the cross-sectional shape of the follower is predominantly oval. However, other, for example, elliptical, cross-sectional shapes or more complex cross-sectional shapes of the follower can also be provided. In the exemplary embodiment in FIG. 8, follower 430 extends predominantly parallel to the axis of rotation D. Follower 430 is disposed between contact arm 220 and clamping arm 210. In the exemplary embodiments in FIGS. 8 and 9, follower 430 is disposed in a region between contact arm 220 and clamping arm 210 in which contact arm 220 and clamping arm 210 are formed predominantly parallel to one another in the closed position GS. This makes it possible to achieve a compact arrangement of spring-clamp terminal block 1.

In the exemplary embodiment of spring-clamp terminal block 1 according to FIG. 8, housing 300 has a receiving part 340 with an interior space 341 for accommodating busbar 100 and clamping spring 200. A cover 360 is accommodated in interior space 341. Cover 360 closes an opening, facing interior space 341, of receiving part 340. In the exemplary embodiment in FIG. 8, part of the conductor guide channel LF with guide wall 331 is formed in cover 360.

Figure 9A:
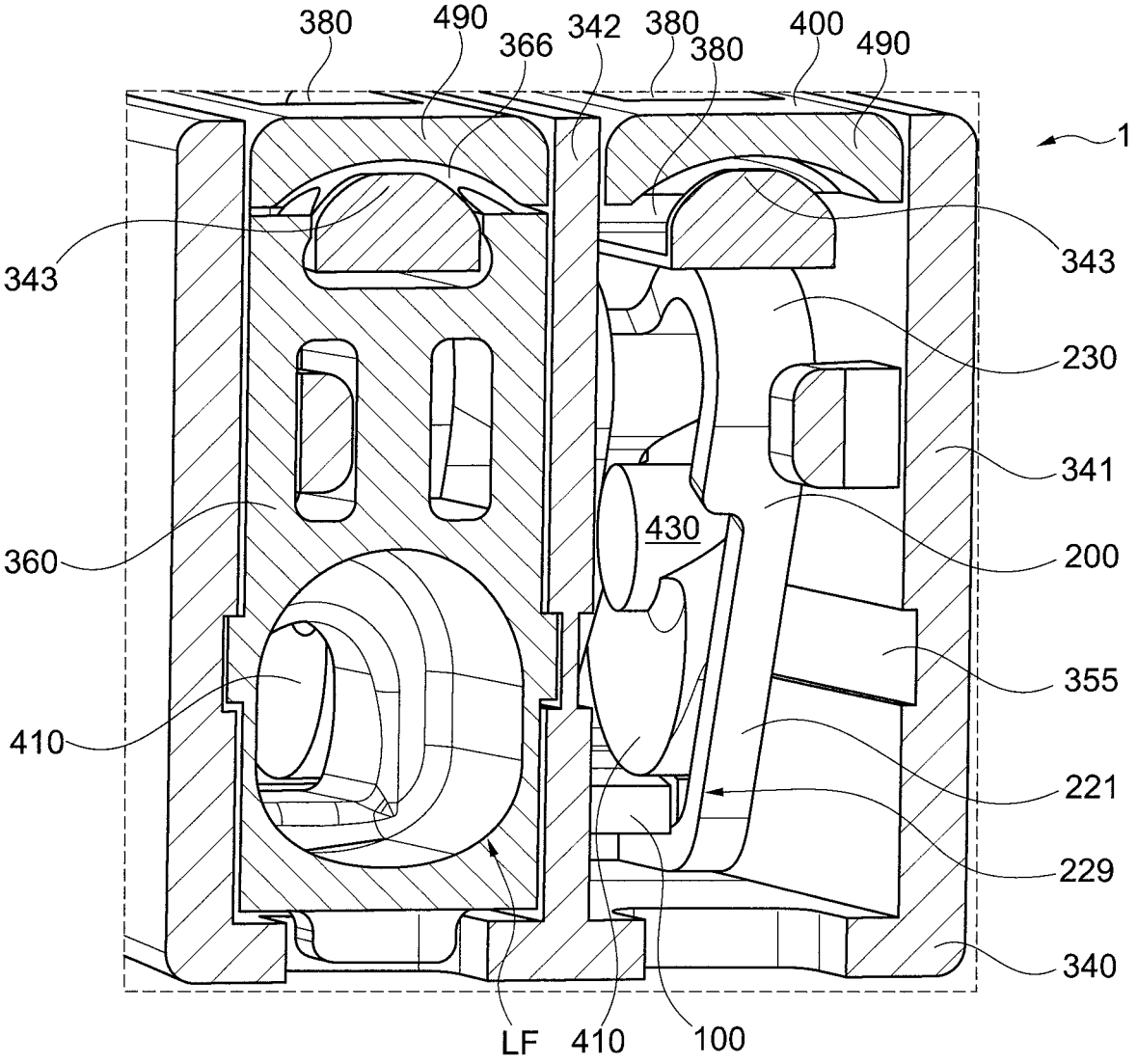
FIG. 9*a* shows an exemplary embodiment with a spring-clamp terminal block in a partial sectional view.
Figure 9B:
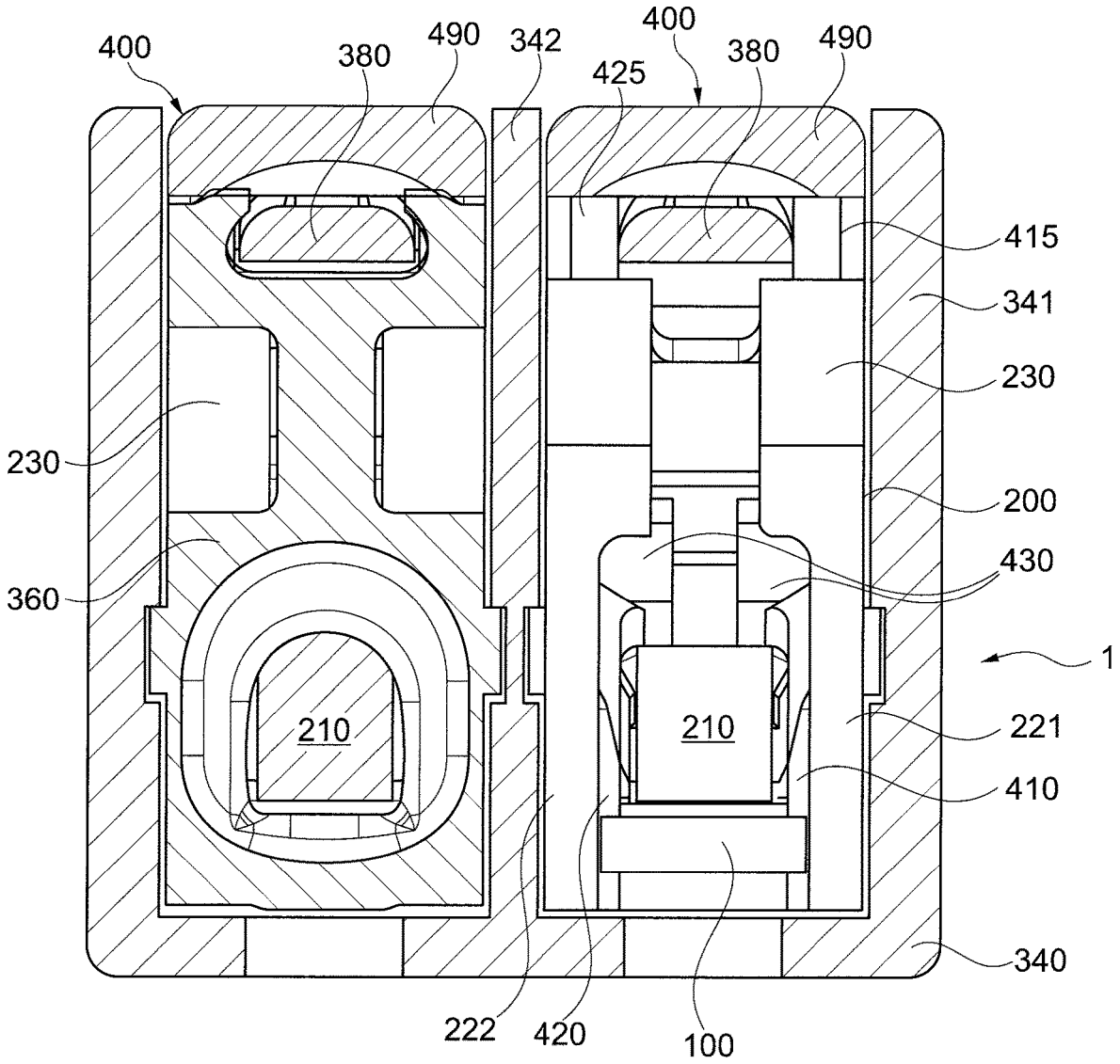
FIG. 9*b* shows an exemplary embodiment with a spring-clamp terminal block in a sectional view.

FIGS. 9*a* and 9*b* show an exemplary embodiment with two spring-clamp terminal blocks 1 in a partial sectional view. Spring-clamp terminal block 1 has a busbar 100 and a clamping spring 200 and a housing 300 and a lever 400. Busbar 100 and clamping spring 200 and lever 400 are at least partially accommodated in housing 300. Lever 400 is mounted within housing 300 and is designed to actuate a clamping arm 210 of clamping spring 200.

Housing 300 has a first housing part 340 and a second housing part 360. In the respective right-hand spring-clamp terminal block 1 in the exemplary embodiments in FIGS. 9*a* and 9*b*, second housing part 360 is removed to allow a view of the elements of spring-clamp terminal block 1 located behind it. First housing part 340 is designed as a base body 340, into which second housing part 360, which is designed as a cover 360, is introduced in order to close a cavity in the interior of base body 340 and to ensure electrical insulation. Correspondingly, in the exemplary embodiment in FIGS. 9*a* and 9*b*, base body 340 and cover 360 are made from an electrically insulating material, for example, from plastic.

First housing part 340 has a housing web 380, which is only shown in section in FIGS. 9*a* and 9*b*. An example of the geometric shape of housing web 380 in its main direction of extension is shown in FIG. 2. The exemplary embodiment in FIG. 2 can be combined with the exemplary embodiment in FIGS. 9*a* and 9*b* to design spring-clamp terminal block 1. As in the exemplary embodiment in FIG. 2 and the exemplary embodiment in FIGS. 9*a* and 9*b*, housing web 380 has a fastening element 343 for fastening to second housing part 360. In FIG. 9*a*, fastening element 343 can be seen as a latching hook 343 which, as shown in the left representation of FIG. 9*a*, engages behind an undercut 366 of cover 360.

Lever 400 has an actuation handle 490 and a first web 415 and a second web 425. Actuation handle 490 is connected to first web 415 and to second web 425. An interspace is formed between first web 415 and second web 425. As shown in FIG. 9*b*, the interspace between first web 415 and second web 425 is at least penetrated by housing web 380. In addition, the interspace can also be penetrated by a clamping arm 210 of clamping spring 200. Clamping arm 210 together with busbar 100 forms a clamping point for clamping the electrical conductor on busbar 100.

Figure 10:
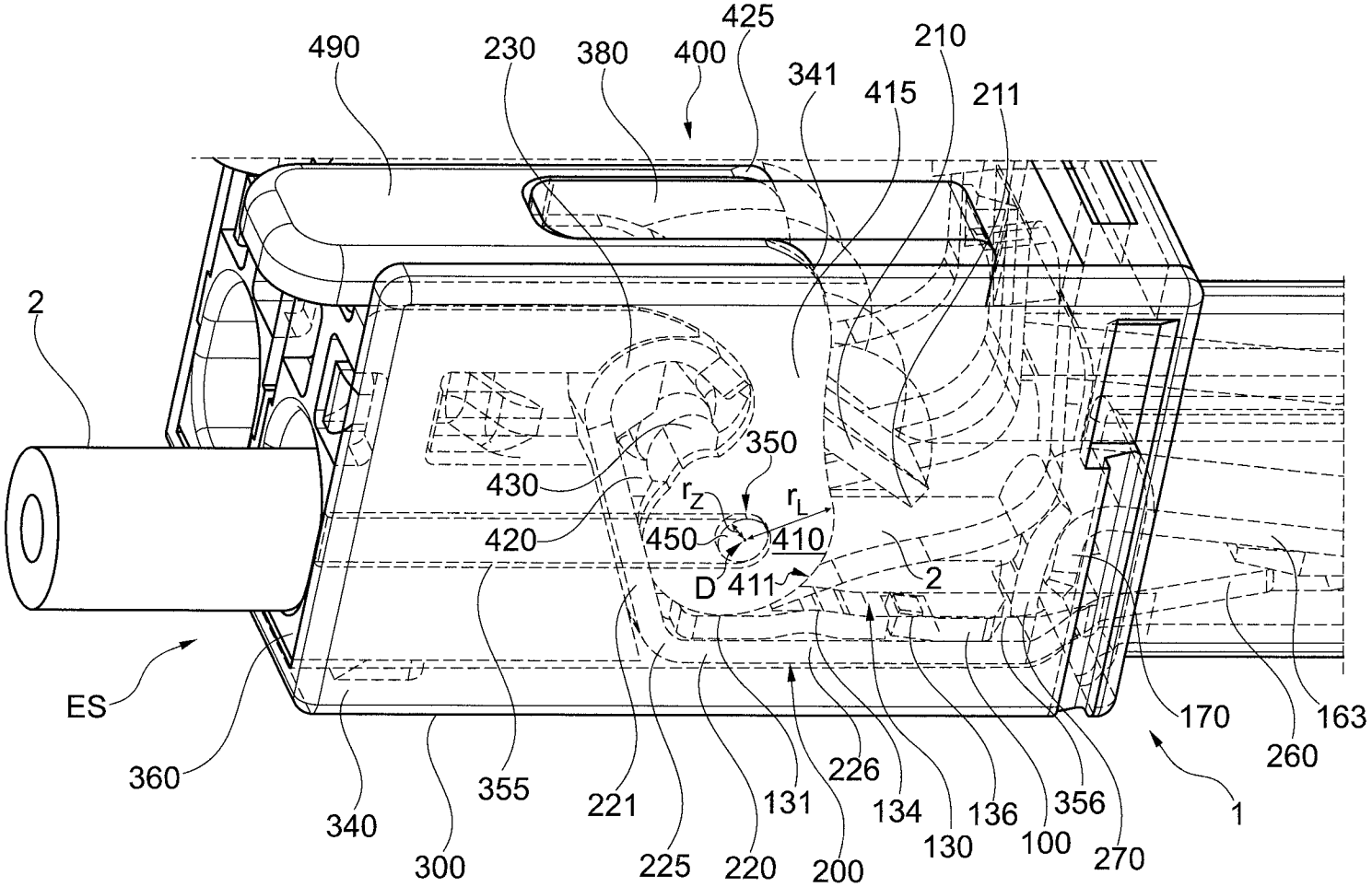
FIG. 10 shows an exemplary embodiment with a spring-clamp terminal block in a three-dimensional view.

As shown in FIG. 9*a* and FIG. 10, in a closed position GS, first web 415 of lever 400 and second web 425 of lever 400 and housing web 380 and walls 341, 342 of housing 300 form a substantially flat surface. Together with actuation handle 490 of the lever, a predominantly closed surface is also formed. In the exemplary embodiment in FIG. 9*a* and in the exemplary embodiment in FIG. 10, to this end, housing web 380 has a recess for receiving actuation handle 490 in the closed position.

The exemplary embodiment in FIG. 9*b* and the exemplary embodiment in FIG. 10 show that first web 415 of lever 400 and/or second web 425 of lever 400 are guided on housing web 380. Accordingly, when lever 400 is actuated, lever 400 can be pivoted, wherein first web 415 and/or second web 425 slide on housing web 380 during the pivoting movement.

FIG. 10 shows an exemplary embodiment of a spring-clamp terminal block 1 for connecting an electrical conductor 2. Spring-clamp terminal block 1 has a housing 300 that is shown in FIG. 10 in a partially transparent manner to show elements of spring-clamp terminal block 1 disposed in housing 300. The housing can be made of a transparent or non-transparent material. A busbar 100 and a clamping spring 200 and partially a lever 400 are accommodated in housing 300. Busbar 100 is pushed with an edge of a bottom section 130 into a groove 356 of housing 300 for fastening. Bottom section 130 has a fastening element 136, which fixes busbar 100 relative to housing 300 in groove 356. For example, fastening element 136 is designed as an opened-out tab 136, the edge of which is directed against the wall of groove 356.

Lever 400 has a first bearing plate 410 with a first outer contour 411 for mounting lever 400 in a first counter bearing. Lever 400 has an actuation handle 490 which is connected to first bearing plate 410 via a web 415. Clamping spring 200 has a clamping arm 210. Clamping arm 210 together with busbar 100 forms a clamping point for clamping electrical conductor 2 on busbar 100. In the exemplary embodiment in FIG. 10, electrical conductor 2 is already clamped in spring-clamp terminal block 1. Clamping arm 210 of clamping spring 200 is deflected and presses conductor 2 against busbar 100. A clamping edge 211 of clamping arm 210 presses into the electrically conductive material of electrical conductor 2. Ideally, electrical conductor 2 is deformed by clamping edge 211, so that the extraction force is significantly increased.

Lever 400 has a follower 430 which is designed to move clamping arm 210 out of a closed position into an open position when lever 400 is pivoted. The state in which lever 400 is in the closed position is shown in the exemplary embodiment in FIG. 10. At the same time, however, electrical conductor 2 is plugged in and clamping arm 210 of clamping spring 200 is deflected, so that clamping arm 210 does not bear against the follower.

First bearing plate 410 bears against the first counter bearing, wherein the first counter bearing is designed to absorb the force of clamping spring 200. The first counter bearing in the exemplary embodiment in FIG. 10 has both a first section 221 of a contact arm 220 and a first section 131 of busbar 100. Contact arm 220 has an angled section 225, so that contact arm 220 is in contact with first bearing plate 410 and extends by an obtuse angle of angled section 225 to below busbar 100; therefore, it bears against busbar 100 on the side opposite the contact point.

The force of clamping spring 200 acts on the first counter bearing via clamping arm 210 and follower 430 and first bearing plate 410 only when clamping arm 210 bears against follower 430. For this purpose, lever 400 would first have to be pivoted into the open position in FIG. 10.

Lever 400 has a first pin 450 which projects axially from first bearing plate 410 and is disposed in a receptacle 350 of housing 300. Pin 450 and receptacle 350 position lever 400 when follower 430, as shown in FIG. 10, is not in contact with clamping arm 210 of clamping spring 200. In the exemplary embodiment in FIG. 10, pin 450 is formed circular, wherein receptacle 350 in housing 300 is formed partially circular. The radius $r_Z$ of circular pin 450 is significantly smaller in this case than the radius $r_L$ of first bearing plate 410. In the exemplary embodiment of FIG. 10, the radius $r_Z$ of circular pin 450 is less than half the radius $r_L$ of first bearing plate 410. In the exemplary embodiment in FIG. 10, pin 450 and first bearing plate 410 have the same pivot point D. Alternatively, the pivot points D of pin 450 and first bearing plate 410 are spaced apart. It is also possible that the pin deviates from a circular shape and is mounted, for example, floating.

In the exemplary embodiment in FIG. 10, pin 450 is formed on the side of first bearing plate 410 that is opposite follower 430, i.e., toward the outside. Alternatively, it is possible, for example, to form pin 450 and receptacle 350 on the same side as follower 430, on the inside.

Basically, pin 450 shown is sufficient for the function of positioning lever 400. In addition to pin 450, a further pin can be disposed on a second bearing plate 420, in particular symmetrically. Accordingly, lever 400 would be formed symmetrical. Tilting of lever 400 would be reduced.

Receptacle 350 has an at least partially circular inner contour in which pin 450 is rotatably mounted. In this regard, the at least partially circular inner contour of receptacle 350 can have a larger radius than the radius $r_Z$ of pin 450. The shape and position of receptacle 350 are designed such that when clamping arm 210 bears against follower 430, no or a significantly reduced force is transmitted from clamping spring 200 to receptacle 350 via pin 450. In the exemplary embodiment in FIG. 10, a groove 355 is provided in housing 300 for assembly, via which pin 450 with lever 400 can be pushed into receptacle 350 during an assembly step.

A further inventive aspect is shown in FIG. 10. In this case, a first bearing shell of a first counter bearing for first bearing plate 410 is formed together by a first section 131 of busbar 100 and a first section 221 of contact arm 220 and a first section of housing 300. A second bearing shell of a second counter bearing for second bearing plate 420 is advantageously formed together by a second section of busbar 100 and a second section of contact arm 220 and a second section of housing 300.

The exemplary embodiment in FIG. 10 shows that housing 300 has stops for lever 400 for the open position and the closed position. FIG. 10 shows that lever 400 strikes plastic housing 300 in the closed position.

Figure 11:
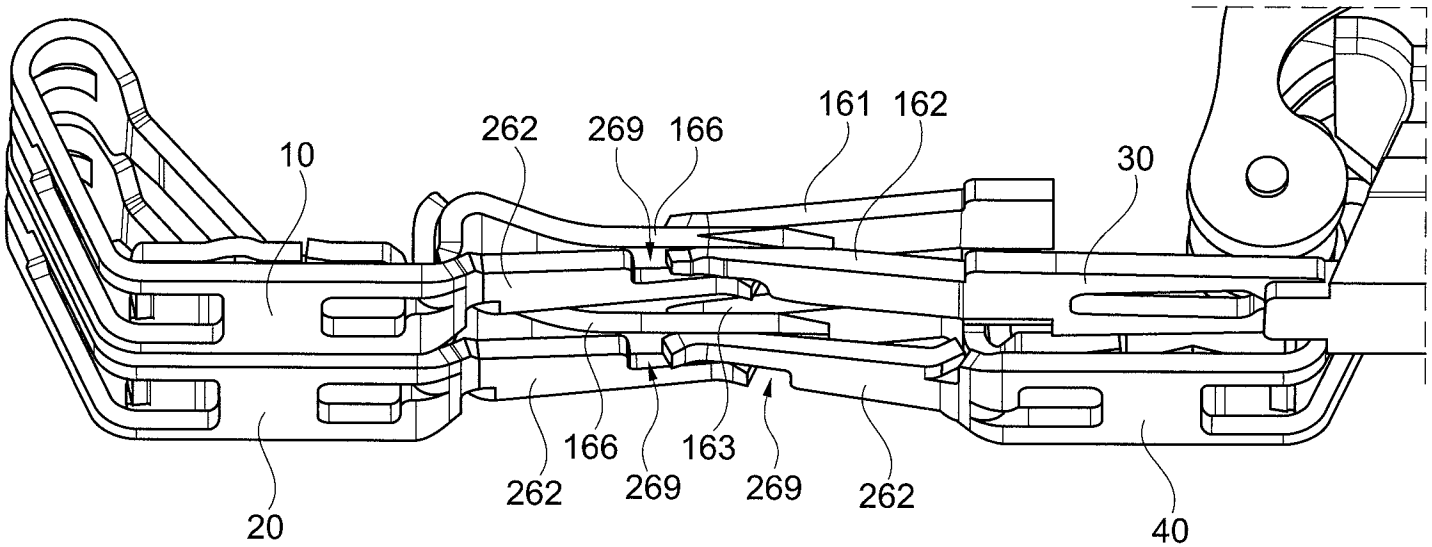
FIG. 11 shows exemplary embodiments with parts of spring-clamp terminal blocks in a three-dimensional view.

FIG. 11 shows a number of exemplary embodiments with busbars and clamping springs of different spring-clamp terminal blocks 10, 20, 30, 40 in a three-dimensional view. In this case, the contact area between spring-clamp terminal blocks 10, 20, 30, 40 is shown, whereas housings, etc., are not shown for simplification.

Elements of four spring-clamp terminal blocks 10, 20, 30, 40 are shown, wherein the fourth spring-clamp terminal block 40 has a bifurcated contact with a prong 163 of the busbar and a prong 262 of the clamping spring. The first and second spring-clamp terminal blocks 10, 20 each have a blade contact, wherein contact blade 166 is formed by the busbar. The third spring-clamp terminal block 30 has a bifurcated contact, wherein prongs 161, 162 are part of the busbar. Prongs 262 of the clamping springs each have an indentation 269, so that the clamping springs of the first, second, and fourth spring-clamp terminal blocks 10, 20, 40 can be manufactured as identical parts. Only the third spring-clamp terminal block 30 has a different clamping spring.

Figure 12A:
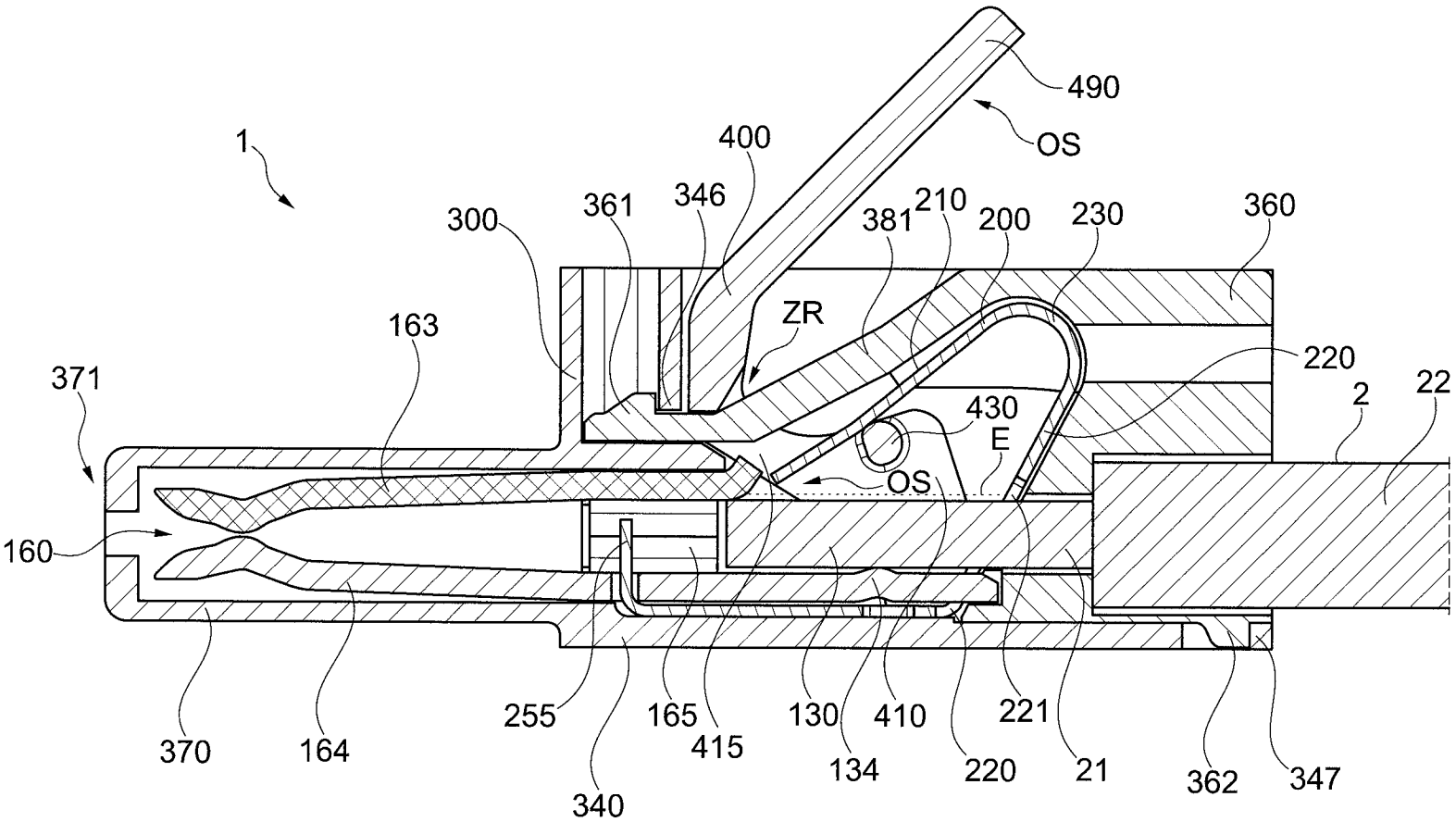
FIGS. 12*a* and 12*b* show an exemplary embodiment with a spring-clamp terminal block in sectional views.
Figure 12B:
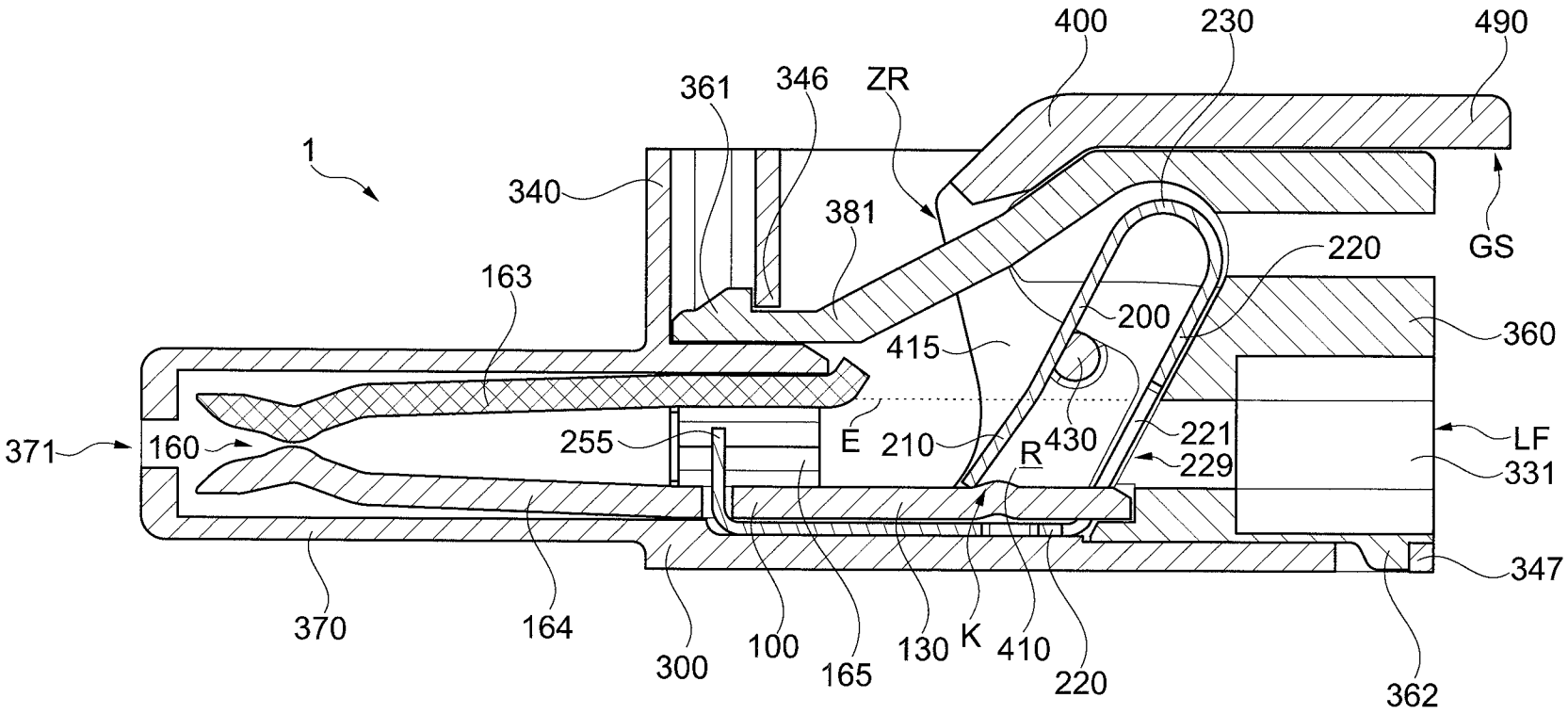

FIGS. 12*a* and 12*b* show an exemplary embodiment of a spring-clamp terminal block 1 for connecting an electrical conductor 2. FIG. 12*a* shows spring-clamp terminal block 1 with a lever 400 in the open position OS and with an inserted conductor in a sectional view. FIG. 12*b* shows spring-clamp terminal block 1 with a lever 400 in the closed position GS likewise in a sectional view.

Spring-clamp terminal block 1 has a busbar 100 and a clamping spring 200 and a housing 300 and lever 400. Busbar 100, clamping spring 200, and lever 400 are at least partially accommodated in housing 300. Housing 300 is advantageously made of an electrically insulating material, for example, plastic.

Lever 400 has a first bearing plate 410 with a first partially circular outer contour for mounting lever 400 in a first counter bearing. The counter bearing in the exemplary embodiment in FIGS. 12*a* and 12*b* is formed by a contact arm 220 of clamping spring 200. Due to the sectional illustration, it cannot be seen in FIGS. 12*a* and 12*b* that lever 400 has a second bearing plate with a second partially circular outer contour for mounting lever 400 in a second counter bearing. The second counter bearing is also formed by contact arm 220 of clamping spring 200. The second bearing plate is spaced from first bearing plate 410. Clamping spring 200 in the exemplary embodiment in FIGS. 12*a* and 12*b* has a clamping arm 210 and a spring bend 230, wherein contact arm 220 is connected to clamping arm 210 via spring bend 230. FIG. 12*b* shows that contact arm 220 has an opening 229 for feeding conductor 2 to the clamping point K. Opening 229 is laterally delimited by webs; in the sectional view in FIG. 12*b*, a web 221 is shown in a plan view. Contact arm 220 extends down to below busbar 100 and has an extension 255 for attachment to busbar 100. Extension 255 also serves to limit an insertion depth of conductor 2.

Busbar 100 has a bottom section 130 for clamping conductor 2. Furthermore, busbar 100 has two prongs 163, 164 to form a bifurcated contact 160, wherein both prongs 163, 164 are connected via a connecting section 165 of busbar 100. Advantageously, both prongs 163, 164, connecting section 165, and bottom section 130 are formed in one piece from a metal. Busbar 100 has a bulge 134 in the direction of conductor 2 to be clamped, which increases the surface pressure on conductor 2 and thus enables improved electrical contact. Alternatively, several bulges or a roughened or grooved surface of bottom section 130 can also be provided for conductor contacting.

In the exemplary embodiment in FIGS. 12*a* and 12*b*, lever 400 has a follower 430 which, when lever 400 undergoes a pivoting movement, moves a clamping arm 210 of clamping spring 200 out of a closed position GS into an open position OS. For actuation by the user, lever 400 has an actuation handle 490 which is connected to first bearing plate 410 and to the second bearing plate. Clamping arm 210 together with busbar 100 forms a clamping point K for clamping electrical conductor 2 on busbar 100. In the exemplary embodiment in FIGS. 12*a* and 12*b*, follower 430 is formed on an inner side of first bearing plate 410. Follower 430 is positioned closer to a free end of clamping arm 210 in the open position OS than in the closed position GS.

It can be seen in FIGS. 12*a* and 12*b* that in this exemplary embodiment follower 430 is arranged closer to contact arm 420 in the closed position GS than in the open position OS. Spring-clamp terminal block 1 of the exemplary embodiment in FIGS. 12*a* and 12*b* can thus be made especially compact.

First partially circular outer contour 411 of first bearing plate 410 defines an axis of rotation D of lever 400 when lever 400 is pivoted out of the closed position GS into the open position OS. In this regard, the axis of rotation D is preferably fixed over the pivoting path. However, outer contour 411 can also define a displacement of the axis of rotation D in the sense of an instantaneous pole if outer contour 411 additionally has a non-partially circular section. Preferably, however, first bearing plate 410 is only in contact with the counter bearing with the partially circular outer contour 411.

In the exemplary embodiment in FIGS. 12*a* and 12*b*, follower 430 is arranged in the open position OS and in the closed position GS outside a space R between busbar 100 and a plane E parallel thereto through the axis of rotation D or above the axis of rotation D. The space R is advantageously delimited laterally by first bearing plate 410 and the second bearing plate. In addition, the space R in the bottom area is delimited by bottom section 130 of busbar 100. The space R is preferably part of a conductor guide channel LF to the clamping point K. Follower 430 is located outside the conductor guide channel LF both in the closed position GS and in the open position OS, so that a conductor 2 to be inserted does not collide with follower 430. Correspondingly, the shape of follower 430 can be optimized for the function of deflecting clamping arm 210.

In the exemplary embodiment in FIGS. 12*a* and 12*b*, housing 300 has a plug-in face 370 for bifurcated contact 160. An opening 371 is provided in plug-in face 370 for feeding a contact blade. Housing 300 has a wall 331 for forming a conductor guide channel LF. The conductor guide channel LF is wider in the initial region in order to accommodate part of an insulation 22 of conductor 2, as shown in FIG. 12*a*. Core 21 of conductor 2 is taken beyond the contact point K in order to ensure good and reliable electrical contacting. The insertion depth for core 21 of conductor 2 is limited by extension 255. In the exemplary embodiment in FIGS. 12*a* and 12*b*, housing 300 is formed from at least two parts 340, 360 which are fastened to one another by means of fastening points 361, 362.

In the exemplary embodiment in FIG. 12*a*, lever 400 has an actuation handle 490 and a first web 415. Furthermore, lever 400 can have a second web. In FIG. 12*a*, the second web would not be visible due to the sectional view. Actuation handle 490 is connected to first web 415 and to the second web, wherein an interspace ZR is formed between first web 415 and the second web. As shown in FIGS. 12*a* and 12*b*, clamping arm 210 extends through the interspace ZR between first web 415 and the second web of lever 400.

Housing 300 has a first housing part 360 and a second housing part 340. Second housing part 340 is designed as a base body 340 and first housing part 360 is designed as a cover 360. Cover 360 can be fastened to base body 340 and closes an opening of base body 340, an opening which points towards the contact insert comprising clamping spring 200 and busbar 100.

First housing part 360 has a housing web 381. Housing web 381 extends in its main direction of extension from cover 360 to base body 340. Housing web 381 has a fastening element 361 for fastening to second housing part 340. Base body 340 as the second housing part has a fastening point 346 that matches fastening element 361. In the exemplary embodiment in FIG. 12*a*, fastening element 361 is formed as a latching hook 361 and fastening point 346 as an associated undercut 346.

Housing web 381 extends through the interspace ZR between first web 415 and the second web. As a result, spring-clamp terminal block 1 can be made especially narrow, because the fastening of housing parts 340, 360 to one another does not cause any additional build-up in width.

The exemplary embodiment in FIG. 12*a* shows that first web 415 of lever 400 and/or second web 425 of lever 400 are formed at an angle to a main direction of extension of actuation handle 490. A large travel path can be achieved in this way. At the same time, actuation section 490 of lever 400 bears against housing 300 in the closed position GS in FIG. 12*b* and spring-clamp terminal block 1 is correspondingly compact. In order to achieve greater stability, further latches 362, 347 can be provided between first housing part 360 and second housing part 340.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A spring-clamp terminal block adapted to connect an electrical conductor, the spring-clamp terminal block comprising:

a busbar;

a clamping spring;

a housing; and a lever, wherein the busbar and the clamping spring and the lever are accommodated at least partially in the housing, wherein the lever has a first bearing plate with a first partially circular outer contour for mounting the lever in a first counter bearing, wherein the lever has a second bearing plate with a second partially circular outer contour for mounting the lever in a second counter bearing, wherein the second bearing plate is spaced apart from the first bearing plate, wherein the lever has an actuation handle that is connected to the first bearing plate and to the second bearing plate, wherein the clamping spring has a clamping arm, wherein the clamping arm together with the busbar forms a clamping point for clamping the electrical conductor on the busbar, and wherein the lever has a follower that is adapted to move the clamping arm from a closed position into an open position when the lever is actuated.

2. The spring-clamp terminal block according to claim 1, wherein the clamping spring has a spring bend and a contact arm, and wherein the clamping arm is connected via the spring bend to the contact arm.

3. The spring-clamp terminal block according to claim 1, wherein the first counter bearing has a first bearing shell, which is formed at least from a first section of the busbar and a first section of a contact arm of the clamping spring, and/or wherein the second counter bearing has a second bearing shell, which is formed at least from a second section of the busbar and a second section of the contact arm of the clamping spring.

4. The spring-clamp terminal block according to claim 1, wherein the first section of the busbar and the first section of the contact arm are arranged at an obtuse angle to form the first bearing shell, and/or wherein the second section of the busbar and the second section of the contact arm are arranged at an obtuse angle to form the second bearing shell.

5. The spring-clamp terminal block according to claim 1, wherein a contact arm of the clamping spring has an opening for feeding the electrical conductor through the opening to the clamping point.

6. The spring-clamp terminal block according to claim 1, wherein the contact arm of the clamping spring has a first web and a second web, wherein the first web and the second web delimit the opening in the contact arm.

7. The spring-clamp terminal block according to claim 1, wherein the first web forms a support for the first bearing plate of the lever and/or wherein the second web forms a support for the second bearing plate of the lever.

8. The spring-clamp terminal block according to claim 1, wherein the housing, in particular the cover, has a first guide wall and/or a second guide wall of a conductor guide channel, and wherein the conductor guide channel guides the electrical conductor to the clamping point.

9. The spring-clamp terminal block according to claim 1, wherein the first bearing shell has a first busbar wall section of the busbar with a partially circular inner contour, and/or wherein the second bearing shell has a second busbar wall section of the busbar with a partially circular inner contour.

10. The spring-clamp terminal block according to claim 1, wherein a conductor guide channel for receiving the conductor in the region of the first bearing plate and the second bearing plate is formed by a space between the first bearing plate and the second bearing plate, and wherein the space is delimited on at least one side by the busbar.

11. The spring-clamp terminal block according to claim 1, wherein the follower is disposed closer to the contact arm in the closed position than in the open position.

12. A spring-clamp terminal block to connect an electrical conductor, the spring-clamp terminal block comprising:

a busbar;

a clamping spring;

a housing; and a lever, wherein the busbar and the clamping spring and the lever are accommodated at least partially in the housing, wherein the clamping spring has a clamping arm, wherein the clamping arm together with the busbar forms a clamping point for clamping the electrical conductor on the busbar, wherein the lever is adapted to move the clamping arm from a closed position into an open position, wherein the busbar has a first prong of a bifurcated contact, and wherein the clamping spring has a second prong of the bifurcated contact.

13. The spring-clamp terminal block according to claim 12, wherein the contact arm of the clamping spring bears against the busbar on a side opposite the clamping point.

14. The spring-clamp terminal block according to claim 12, wherein the busbar has a contact section with the clamping point, a connecting section, and a first prong of a bifurcated contact, and wherein the connecting section connects the contact section to the first prong.

15. The spring-clamp terminal block according to claim 12, wherein the connecting section of the busbar is formed substantially perpendicular to the contact section.

16. The spring-clamp terminal block according to claim 12, wherein the connecting section of the busbar is formed substantially perpendicular to the first prong.

17. The spring-clamp terminal block according to claim 12, wherein the clamping spring is supported on the connecting section.

18. The spring-clamp terminal block according to claim 12, wherein the clamping spring has a first bearing element for support on a side of the connecting section, the side facing the clamping point and/or a second bearing element for support on a side of the connecting section, the side facing away from the clamping point.

19. The spring-clamp terminal block according to claim 12, wherein the first counter bearing and/or the second counter bearing enable a translational and a rotational movement of the lever so that the clamping arm is adapted to be actuated out of the closed position into the open position by the rotational pivoting of the actuation handle and/or by the translational pressing of the actuation handle.

20. A spring-clamp terminal block for connecting an electrical conductor, the spring-clamp terminal comprising:

a busbar;

a clamping spring;

a housing; and a lever, wherein the busbar and the clamping spring and the lever are accommodated at least partially in the housing, wherein the lever is mounted in a first counter bearing and/or the lever is mounted in a second counter bearing, wherein the lever has an actuation handle, wherein the clamping spring has a clamping arm, wherein the clamping arm together with the busbar forms a clamping point for clamping the electrical conductor on the busbar, wherein the lever has a follower which is adapted to move the clamping arm from a closed position into an open position when the lever is actuated, and wherein the first counter bearing and/or the second counter bearing enable a translational and a rotational movement of the lever so that the clamping arm is adapted to be actuated out of the closed position into the open position by the rotational pivoting of the actuation handle and by the translational pressing of the actuation handle.

* * * * *